US010863801B2

(12) United States Patent
Hosokawa et al.

(10) Patent No.: US 10,863,801 B2
(45) Date of Patent: Dec. 15, 2020

(54) TAPE MEMBER FOR SLIDE FASTENER AND MANUFACTURING METHOD OF TAPE MEMBER

(71) Applicant: YKK Corporation, Tokyo (JP)

(72) Inventors: Yusuke Hosokawa, Toyama (JP); Yuko Fukuda, Toyama (JP); Yoshiyuki Sho, Toyama (JP); Naoyuki Himi, Toyama (JP)

(73) Assignee: YKK Corporation

( * ) Notice: Subject to any disclaimer, the term of this patent is extended or adjusted under 35 U.S.C. 154(b) by 186 days.

(21) Appl. No.: 15/772,763

(22) PCT Filed: Dec. 2, 2015

(86) PCT No.: PCT/JP2015/083909

§ 371 (c)(1),
(2) Date: May 1, 2018

(87) PCT Pub. No.: WO2017/094145

PCT Pub. Date: Jun. 8, 2017

(65) Prior Publication Data

US 2018/0317614 A1 Nov. 8, 2018

(51) Int. Cl.
*A44B 19/24* (2006.01)
*A44B 19/34* (2006.01)
(Continued)

(52) U.S. Cl.
CPC ..... *A44B 19/34* (2013.01); *A44B 19/02* (2013.01); *A44B 19/403* (2013.01); *A44B 19/42* (2013.01); *A44B 19/46* (2013.01); *A44B 19/32* (2013.01)

(58) Field of Classification Search
CPC ..... A44B 19/02; A44B 19/403; A44B 19/42; A44B 19/34; A44B 19/46
See application file for complete search history.

(56) References Cited

U.S. PATENT DOCUMENTS 1,817,837 A 8/1931 Poux
2,858,592 A * 11/1958 Schwartz ..... A44B 19/406 24/396
(Continued)

FOREIGN PATENT DOCUMENTS

EP 1 048 237 A1 11/2000
EP 1 541 052 A1 6/2005
(Continued)

OTHER PUBLICATIONS

Office Action, Japanese Patent Application No. 2017-553555, dated Feb. 5, 2019.
(Continued)

*Primary Examiner* — Jason W San
(74) *Attorney, Agent, or Firm* — Kilpatrick Townsend & Stockton LLP

(57) ABSTRACT

A slide fastener tape member includes a tape body and a core string portion disposed at a tape side edge portion of the tape body along a length direction. The core string portion is formed by fixing a string member at the tape side edge portion along the length direction by machine sewing. The string member is fixed linearly such that at least one thread used for machine sewing crosses while contacting an outer peripheral surface of the string member without being pierced by a needle thread of machine sewing. Thus, since the core string portion can be easily provided by fixing the string member to the tape body having desired properties at a later stage, the value-added tape members can be easily manufactured at a relatively low cost.

9 Claims, 16 Drawing Sheets

(51) Int. Cl.

| | |
|---|---|
| ***A44B 19/40*** | (2006.01) |
| ***A44B 19/46*** | (2006.01) |
| ***A44B 19/02*** | (2006.01) |
| ***A44B 19/42*** | (2006.01) |
| *A44B 19/32* | (2006.01) |

(56) References Cited

U.S. PATENT DOCUMENTS

| | | | | |
|---|---|---|---|---|
| 3,343,234 | A * | 9/1967 | Chery | A44B 19/406 24/396 |
| 3,412,438 | A * | 11/1968 | Sim | A44B 19/12 24/391 |
| 3,600,767 | A | 8/1971 | Cowdrey et al. | |
| 3,665,879 | A * | 5/1972 | Sohr | A44B 19/12 29/410 |
| 3,884,168 | A * | 5/1975 | Heimberger | A44B 19/403 112/475.16 |
| 4,078,280 | A * | 3/1978 | Moertel | A44B 19/34 24/391 |
| 4,133,084 | A * | 1/1979 | Yoshida | A44B 19/34 24/393 |
| 4,134,184 | A * | 1/1979 | Motta | A44B 19/54 24/396 |
| 4,190,935 | A * | 3/1980 | Matsuda | A44B 19/34 24/414 |
| 4,290,194 | A * | 9/1981 | Takahashi | A44B 19/42 29/766 |
| 4,443,923 | A * | 4/1984 | Takahashi | A44B 19/42 29/33.2 |
| 4,485,532 | A * | 12/1984 | Yoshida | A44B 19/38 24/381 |
| 4,601,085 | A * | 7/1986 | Yoshida | A44B 19/32 24/384 |
| 4,718,149 | A * | 1/1988 | Tsubokawa | A44B 19/34 24/392 |
| 5,035,029 | A * | 7/1991 | Horita | A44B 19/02 24/394 |
| 6,427,294 | B1 * | 8/2002 | Shibaike | A44B 19/32 24/381 |
| 6,427,295 | B1 * | 8/2002 | Matsumoto | A44B 19/42 24/397 |
| 2005/0235466 | A1 * | 10/2005 | Segawa | A44B 19/34 24/396 |
| 2011/0005042 | A1 * | 1/2011 | Thomas | A44B 19/34 24/381 |
| 2012/0110795 | A1 * | 5/2012 | Daijogo | D03D 1/00 24/392 |
| 2012/0246888 | A1 * | 10/2012 | Matsushima | D05B 35/064 24/403 |
| 2013/0232737 | A1 * | 9/2013 | Shimono | A44B 19/04 24/427 |
| 2013/0333166 | A1 * | 12/2013 | Shimono | A44B 19/32 24/435 |
| 2014/0230197 | A1 * | 8/2014 | Miyazaki | A44B 19/62 24/415 |
| 2014/0359978 | A1 * | 12/2014 | Wang | A44B 19/32 24/389 |
| 2015/0374077 | A1 * | 12/2015 | Yoneoka | A44B 19/02 24/409 |
| 2018/0317614 | A1 * | 11/2018 | Hosokawa | A44B 19/34 |
| 2019/0254388 | A1 * | 8/2019 | Adachi | A44B 19/34 |
| 2019/0357638 | A1 * | 11/2019 | Sho | A44B 19/38 |

FOREIGN PATENT DOCUMENTS

| | | | |
|---|---|---|---|
| GB | 1 209 365 | A | 10/1970 |
| JP | 38-006721 | Y1 | 4/1963 |
| JP | 44-011298 | B1 | 5/1969 |
| JP | 2000-312604 | A | 11/2000 |
| JP | 2004-016688 | A | 1/2004 |
| WO | 2013/057807 | A1 | 4/2013 |

OTHER PUBLICATIONS

International Search Report, PCT Patent Application No. PCT/JP2015/083909, dated Feb. 23, 2016.

Extended European Search Report, European Patent Application No. 15909775.7, dated May 31, 2019.

Notice of Reasons for Refusal, Japanese Patent Application No. 2017-553555, dated Jul. 31, 2019.

* cited by examiner

TAPE MEMBER FOR SLIDE FASTENER AND MANUFACTURING METHOD OF TAPE MEMBER

TECHNICAL FIELD

The present invention relates to a tape member for a slide fastener in which a core string portion bulging in a top and back direction from a tape body is provided at a tape side edge portion of the tape body and a method for manufacturing the tape member.

BACKGROUND ART

A slide fastener has a right and left pair of fastener stringers in which element rows formed of a plurality of fastener elements are formed on a tape edge portion of a narrow width fastener tape, and a slider to be attached to the element rows. Such a slide fastener can be opened and closed by sliding the slider along the element rows to couple and separate the right and left fastener elements.

In a fastener stringer obtained by injection-molding synthetic resin fastener elements to a fastener tape or a fastener stringer obtained by plastically deforming and fixing metal fastener elements to a fastener tape, for example, a core string portion bulging in the tape top and back direction is generally formed at the tape side edge portion of the fastener tape in order to enhance an attaching strength of the fastener elements to the fastener tape.

As an example of such a fastener tape having a core string portion, a fastener tape to which metal fastener elements are attached is disclosed in FIG. 3 in International Publication No. WO2013/057807 A (Patent Document 1). The fastener tape in Patent Document 1 is woven using a weft made of synthetic fiber such as polyester fiber and a plurality of warps.

The fastener tape of Patent Document 1 has a tape main body portion to be sewn to a fastener attached product such as clothing items or bags, and a tape side edge portion (also referred to as an element attaching portion) extending from one side edge of the tape main body portion in a tape width direction and to which a plurality of fastener elements are attached. On a facing side edge in the tape side edge portion which faces a counterpart fastener tape, a core string portion bulging in the tape top and back direction is provided.

In Patent Document 1, the core string portion of the fastener tape is formed such that a hollow weave structure is formed at the facing side edge of the fastener tape and a string member called a core string is held and fixed in the hollow weave structure. That is, the core string portion of Patent Document 1 is integrally provided with the fastener tape by supplying the string member along with the warps, and forming the hollow weave structure to wrap the string member using the warps and the weft at the time of weaving the fastener tape.

U.S. Pat. No. 1,817,837 specification (Patent Document 2), for example, discloses a fastener tape in which a core string portion is formed by sewing a string member to a tape side edge portion. In one of the fastener tapes described in the Embodiments of Patent Document 2, the core string portion is formed at the tape side edge portion of the fastener tape along a tape length direction such that the tape side edge portion is twisted around the string member so as to wrap the string member inside, sewing is conducted in a state that the tape side edge portion is twisted around the string member, and a sewing thread forming a stitch line pierces the string member and the tape side edge portion twisted around the string member, thereby the string member is sewn to the tape side edge portion.

Meanwhile, in a fastener tape according to another embodiment described in Patent Document 2, the sewing thread forming a stitch line pierces a bare string member and the tape side edge portion of the fastener tape so as the string member to be sewn at the tape side edge portion along the tape length direction, thereby the core string portion is formed at the tape side edge portion.

In the fastener tape according to the above two embodiments described in Patent Document 2, the sewing thread forming a stitch line pierces the string member and the tape side edge portion, thereby the string member is fixed at the tape side edge portion along the length direction to form the core string portion.

Patent Document 2 also discloses a fastener tape in which the core string portion is formed by disposing the string member at the tape side edge portion along the tape length direction, covering the string member with the tape side edge portion so as to wrap it inside, and overlapping and sewing tape parts adjacent to an inside and an outside of a tape covering portion which covers the string member each other. The core string portion of this kind of fastener tape is formed such that the sewing thread does not pierce the string member, but the string member holds a state wrapped by the tape side edge portion with the stitch line of the sewing thread.

PRIOR ART DOCUMENT

Patent Documents

Patent Document 1: International publication No. WO 2013/057807

Patent Document 2: U.S. Pat. No. 1,817,837

SUMMARY OF INVENTION

Problems to be Solved by the Invention

Conventionally, cloths used for clothing items and bags are formed using various synthetic fiber or natural fiber depending on use. Recently, fibers and cloths having various functions such as waterproof property and moisture permeability, water absorption (sweat absorption) and quick dry property, heat storage property and antifouling property have been developed and used for the cloths for clothing items and bags. In addition to the above kinds of cloths, clothing items and bags are manufactured using various materials such as natural leather from animal and synthetic leather, in some cases.

Meanwhile, when a slide fastener is attached to clothing items and bags, a fastener tape used for the slide fastener is generally formed using synthetic fiber such as polyester fiber. Forming the fastener tape using materials other than synthetic fiber or applying functions such as waterproof property and moisture permeability to the fastener tape itself are hardly conducted, due to low cost-effectiveness. Therefore, the current situation is that variation of the fastener tapes is limited compared to the variation of cloths and materials used for clothing items and bags.

Particularly, in a case of manufacturing a fastener tape having a core string portion, it is common that while forming a hollow weave structure at facing side edges of the fastener tape at the time of weaving, the string member is held and fixed in the hollow weave structure as mentioned in Patent Document 1. Therefore, materials other than woven fabrics have been hardly used as a fastener tape having a core string portion. Further, when functions such as waterproof property and moisture permeability are applied to a fastener tape woven as above, there have been a problem of significantly increased manufacturing cost compared to a case of purchasing a cloth having a desired function and forming a core string portion by sewing the string member to the cloth.

On the other hand, it is also possible to form a fastener tape by providing a core string portion at a tape side edge portion made of a desired material such that an arbitrary material including a cloth and a leather having desired functions such as waterproof property and moisture permeability is prepared, and a string member is guided and sewn to the tape side edge portion of the prepared material to form a stitch line so that a sewing thread (needle thread) pierces the string member, as mentioned in Patent Document 2.

In the case of actually forming the core string portion as mentioned in Patent Document 2, although the string member needs to be sewn to the tape side edge portion while the sewing machine needle pierces the string member, the string member itself is relatively thin and easy to move at the time of sewing, and a position of the string member tends to move when the sewing needle pierces. Therefore, it is difficult that the thin string member is pierced precisely at a predetermined position by the sewing machine needle, and there was a problem that high technical skill is required to stably fix the thin string member at a predetermined position of the tape side edge portion along the whole length direction by piercing of the sewing machine needle.

Patent Document 2 also discloses a fastener tape in which a core string portion is formed by sewing an inner adjacent part and an outer adjacent part of a tape covering portion in a state that a tape side edge portion wraps a string member inside, thereby the sewing thread does not pierce the string member. It is also possible to form a fastener tape in which the core string portion is provided on a material such as cloths having a desired function by utilizing such a shape.

In this case, although the string member is wrapped with the tape covering portion of the tape side edge portion, the string member is not fixed within the tape covering portion. Therefore, the string member may move in the tape covering portion in the tape length direction. Thus, problems occur that defects tend to occur that when fastener elements are attached by injection-molding a synthetic resin material, a posture of the fastener element is inclined, a position of the fastener element is misaligned in the tape length direction, or water leakage at the time of the injection molding.

The present invention has been made in view of the problems of the above conventional technique, and a specific object of the invention is to provide a tape member for a slide fastener in which a core string portion is formed by sewing a string member to an arbitrary material at a predetermined position with a sewing thread by machine sewing without piercing the string member, and the fixed string member can be prevented or suppressed from moving in the length direction, as well as a manufacturing method of the tape member.

Means for Solving the Problems

In order to achieve the above object, a tape member for a slide fastener provided by the present invention is, as a most principal structure, a tape member for a slide fastener which a plurality of fastener elements are attached to and supported by and including a flexible tape body and a core string portion disposed at a tape side edge portion of the tape body along a length direction and bulging in a top and back direction from the tape body, in which the core string portion is formed by fixing a string member to the tape side edge portion along the tape length direction by machine sewing, and the string member is fixed to the tape side edge portion linearly such that a needle thread of machine sewing does not pierce the string member, and at least one thread used for machine sewing crosses an outer peripheral surface of the string member which is opposite to an inner peripheral surface contacting the tape body while contacting with it.

In the tape member according to the present invention, it is preferable that the string member is fixed only with the needle thread and is formed thicker than the needle thread. In this case, it is preferable that the tape side edge portion has a first tape surface on which the needle thread runs and a second tape surface disposed opposite to the first tape surface and in which the needle thread pierces the tape side edge portion and forms loops, and the string member is fixed to the second tape surface of the tape side edge portion such that the needle thread extends across the outer peripheral surface of the string member twice per stitch.

In the tape member according to the present invention, it is also possible that the string member is fixed with lock stitches formed to be bent in a zigzag shape with respect to the tape length direction using the needle thread and a bobbin thread, the tape side edge portion has the first tape surface on which the needle thread runs and the second tape surface disposed opposite to the first tape surface and on which the bobbin thread runs, and the string member is inserted between the needle thread and the first tape surface or between the bobbin thread and the second tape surface, and is fixed to the tape side edge portion with the needle thread or the bobbin thread crossing the outer peripheral surface of the string member in a zigzag shape.

Further, in the tape member according to the present invention, it is also possible that the string member is fixed with overedge chain stitches formed using the needle thread and one or two looper threads, the tape side edge portion has the first tape surface on which the needle thread runs and the second tape surface disposed opposite to the first tape surface and on which the needle thread pierces the tape side edge portion to form a loop, the string member is inserted between the looper thread and the first or second tape surface, and is fixed to the tape side edge portion with the looper thread crossing the outer peripheral surface of the string member per stitch.

In the tape member according to the present invention, it is preferable that the string member has a first string member and a second string member disposed parallel to each other on one tape surface of the tape side edge portion, the tape side edge portion has a first tape fixing portion to which the first string member is fixed and a second tape fixing portion to which the second string member is fixed, and the second tape fixing portion is folded back with respect to the first tape fixing portion to the other tape surface of the first tape fixing portion.

Particularly in this case, it is preferable that the first tape fixing portion and the folded second tape fixing portion are sewn to each other with a tape sewing line formed at a position on a tape inside of the first and second string members along the first and second string members.

In the tape member according to the present invention, it is also possible that the tape side edge portion has a tape fixing portion in which the string member is fixed to one tape surface and a tape turning back portion to be folded back with respect to the tape fixing portion to the other tape surface of the tape fixing portion, and the tape turning back portion is sewn to the tape fixing portion together with the string member by machine sewing to fix the string member in a state that the tape turning back portion is folded back and overlapped on the tape fixing portion.

Further, in the tape member of the present invention, it is also possible that the tape side edge portion has, in a cross-sectional view perpendicular to the length direction of the tape member, a tape covering portion which wraps and covers the string member inside, a first adjacent portion disposed adjacent to one side of the tape covering portion and a second adjacent portion disposed adjacent to the other side of the tape covering portion, and the first adjacent portion and the second adjacent portion are sewn to each other with the tape sewing line formed along the string member in a state that the string member is wrapped with the tape covering portion.

And, according to the present invention, a slide fastener having a right and left pair of fastener stringers in which a plurality of fastener elements are attached to the tape member having the above structural features is provided.

Next, a method for manufacturing a tape member for a fastener tape provided by the present invention is a method for manufacturing a tape member for a slide fastener having a core string portion bulging from a flexible tape body in a top and back direction by fixing a string member to a tape side edge portion of the tape body along a tape length direction using a sewing machine, the method including using the string member as a looper thread for multi-thread chain stitching, piercing the tape side edge portion with a needle thread and interlooping a loop of the needle thread and a loop of the string member each other by a motion of a sewing machine needle and a looper of the sewing machine conducting multi-thread chain stitching, and at the time of the motion conducting the multi-thread chain stitching, drawing the string member linearly by applying tension to the string member intermittently per stitch of the sewing machine, and fixing the string member to the tape side edge portion with the loop of the needle thread as a most principal configuration.

Effects of the Invention

A tape member for a slide fastener according to the present invention has a flexible tape body and a core string portion formed by fixing a string member to a tape side edge portion of the tape body along a tape length direction by machine sewing. The string member of the core string portion is fixed linearly at the tape side edge portion such that at least one thread used for machine sewing crosses while contacting an outer peripheral surface of the string member.

According to the tape member of the present invention configured as above, the string member is fixed to the tape side edge portion of the tape body so as to be held with a sewing thread such as a needle thread used for machine sewing.

That is, in the tape member of the present invention, arbitrary material such as cloths provided with a desired function can be used as a tape body, and the string member can be sewn to the tape side edge portion of the tape body along the whole tape length direction without being pierced with the sewing thread used for machine sewing. Therefore, the core string portion can be easily and stably formed at a predetermined position of the arbitrary material.

In the string member fixed at the tape side edge portion, at least one sewing thread crosses while contacting the outer peripheral surface of the string member. Therefore, the string member is stably fixed to the tape side edge portion, and the string member can be effectively prevented or suppressed from moving in the tape length direction or the tape width direction, thereby it can be prevented that a position of the core string portion is misaligned or the core string portion is deformed.

In such a tape member of the present invention, the string member which is thicker than the needle thread is fixed at the tape side edge portion only with the needle thread. Since the thick string member is fixed with crossing of the needle thread which pierces the tape side edge portion, the core string portion can be stably and linearly formed on the tape member without being pierced with the needle thread.

Particularly in this case, the tape side edge portion of the tape body has a first tape surface on which the needle thread runs and a second tape surface disposed opposite to the first tape surface and on which the needle thread pierces the tape side edge portion and forms a loop. The string member is used as a looper thread for multi-thread chain stitching at the time of machine sewing, and is disposed to be drawn linearly by applying tension intermittently per stitch of the sewing machine. The string member is fixed to the second tape surface of the tape side edge portion such that the needle thread extends across the outer peripheral surface of the string member twice per stitch.

The string member can be firmly and stably fixed linearly to the tape side edge portion by forming the core string portion by drawing straight the looper thread for multi-thread chain stitching to serve as the string member and fixing the string member by interlooping with the needle thread. When conducting machine sewing, the string member does not need to be prepared and guided separately from the sewing thread. Therefore, the core string portion can be easily and efficiently formed to an arbitrary material only by machine sewing.

Further in this case, the string member is fixed using a multi-thread chain stitch sewing machine in which a sewing machine needle and a looper conduct multi-thread chain stitching. Therefore, because of the structure of the sewing machine, it is possible to supply the looper thread (string member) long and continuously, and the string member can be fixed by machine sewing in longer distance and continuously in the tape length direction, compared with a case of forming lock stitches which requires exchanging a bobbin thread.

In the tape member of the present invention, the string member may be fixed with the lock stitches using the needle thread and the bobbin thread formed to be bent in a zigzag shape with respect to the tape length direction. In this case, the tape side edge portion of the tape body has a first tape surface on which the needle thread runs and a second tape surface disposed opposite to the first tape surface and on which the bobbin thread runs. The string member is inserted between the needle thread and the first tape surface of the tape side edge portion or between the bobbin thread and the second tape surface of the tape side edge portion, and is fixed to the tape side edge portion with the needle thread or the bobbin thread extending across an outer peripheral surface of the string member in a zigzag shape.

Since the string member is fixed using the lock stitches in a zigzag shape, the linearly disposed string member is fastened with the needle thread or the bobbin thread per stitch of the sewing machine without being pierced with the needle thread. Therefore, the string member can be firmly and stably fixed to the tape side edge portion. Thus, the core string portion can be easily formed on an arbitrary material.

Further, in the tape member of the present invention, the string member may be fixed by overedge chain stitching formed using the needle thread and one or two looper threads. In this case, the tape side edge portion of the tape body has a first tape surface on which the needle thread runs and a second tape surface disposed opposite to the first tape surface and on which the needle thread pierces the tape side edge portion to form a loop and to interloop with the looper thread. The string member is inserted between the looper thread and the first or second tape surface of the tape side edge portion, and is fixed to the tape side edge portion such that the looper thread extends across the outer peripheral surface of the string member at regular intervals per stitch.

Since the string member is fixed with overedge chain stitching as above, the string member can be firmly and stably fixed linearly to the tape side edge portion even though the needle thread does not pierce the core string portion, and the core string portion can be easily formed to an arbitrary material.

In the tape member of the present invention as mentioned above, the string member has a first string member and a second string member disposed parallel to each other at predetermined intervals on one tape surface of the tape side edge portion, and the tape side edge portion has a first tape fixing portion to which the first string member is fixed and a second tape fixing portion to which the second string member is fixed. The second tape fixing portion of the tape side edge portion is folded back to the other tape surface of the first tape fixing portion with respect to the first tape fixing portion.

Thereby, the core string portion can be easily formed on both top and back surfaces of the tape side edge portion of the tape member which is exposed in a top and back direction (i.e. on an outer surface on a top side and an outer surface on a back side). In this case, even when a tip end (side edge end) of the tape side edge portion of the tape body in the tape width direction remains unprocessed after cut, the second tape fixing portion is folded back so that the side edge end is not exposed outside.

Therefore, when a slide fastener is formed, tape side edges (i.e. folded ends) facing to each other in the right and left tape members look tidy. Thus, an appearance quality of the slide fastener is improved, and defects such as fray of the thread at the tape side edge portion of the right and left tape members are less likely to occur, which can stably maintain quality and performance of the slide fastener for a long period of time.

Further in this case, the first tape fixing portion of the tape side edge portion and the folded second tape fixing portion are sewn to each other with a tape sewing line formed at a position inside of the first and second string members in the tape width direction along the first and second string members. Thereby, a state that the second tape fixing portion is folded back is stably maintained, and it can be effectively prevented that the side edge end of the tape body is exposed outside. Further, attaching operation of fastener elements afterwards can be conducted stably.

In the tape member of the present invention, it is also possible that the tape side edge portion of the tape body has a tape fixing portion which fixes the string member to one tape surface and a tape turning back portion to be folded back to the other tape surface of the tape fixing portion with respect to the tape fixing portion, and machine sewing is conducted to fix the string member in a state that the tape turning back portion is folded to and overlapped with the tape fixing portion, thereby the tape turning back portion is sewn to the tape fixing portion together with the string member.

Thereby, the core string portion can be easily formed at the tape side edge portion of the tape member. Further, even when the tip end (side edge end) of the tape side edge portion of the tape body in the tape width direction remains unprocessed after cut, the tape turning back portion is sewn together with the string member in a state of being folded back to the tape fixing portion, when forming the slide fastener, the tape side edges (i.e. folded ends) of the right and left tape members facing to each other look tidy, and defects such as fray of thread at the tape side edge portion of the right and left tape member are less likely to occur.

Further, in the tape member of the present invention, it is also possible that the tape side edge portion of the tape body has, in a cross-sectional view perpendicular to the length direction of the tape member, a tape covering portion wrapping and covering the string member inside, a first adjacent portion disposed adjacent to one side of the tape covering portion and a second adjacent portion disposed adjacent to the other side of tape covering portion, and in a state that the string member is wrapped with the tape covering portion, the first adjacent portion and the second adjacent portion are sewn to each other with a tape sewing line formed at a position along an inside in the tape width direction with respect to the string member.

Thereby, the core string portion can be easily formed at the tape side edge portion of the tape member, and the string member is covered with and protected by the tape covering portion. Therefore, it can be prevented that the string member is frayed or cut even when receiving an external force. Further, even when the tip end (side edge end) of the tape side edge portion of the tape body in the tape width direction is unprocessed after cut, the first adjacent portion and the second adjacent portion are sewn in a state that the side edge end faces inside of the tape body. Therefore, when the slide fastener is formed, the tape side edges of the right and left tape members facing to each other look tidy, and defects such as fray of thread at the tape side edge portion of the right and left tape members are less likely to occur.

And, since a slide fastener provided by the present invention is formed using a right and left pair of fastener stringers in which a plurality of fastener elements are attached to the tape member provided with a structure as above, it has primary properties of a slide fastener such as slidability and lateral pulling strength appropriately and stably. Further, it becomes a high quality slide fastener having a new added value that the tape body of the tape member has a desired function such as waterproof property and moisture permeability.

Next, a method for manufacturing a tape member for a slide fastener provided by the present invention is that when the tape member having a core string portion bulging from a tape body in a top and back direction is manufactured by fixing a string member to a tape side edge portion of the flexible tape body along a tape length direction using a sewing machine, a thread thinner than the string member, for example, is used as a needle thread, and the string member is used as a looper thread for multi thread chain stitching.

As a sewing machine needle of the sewing machine and a looper conduct multi thread chain stitching, the needle thread pierces the tape side edge portion and a loop of the needle thread and a loop of the string member interloop with each other. At the time of conducting multi thread chain stitching, tension is applied to the string member intermittently per stitch of the sewing machine, and the string member is linearly drawn and the string member is fixed to the tape side edge portion with the loops of the needle thread.

Explaining more specifically, when conducting multi-thread chain stitching in the present invention, tension is intermittently applied to the string member sewn and folded with the stitch pattern of the multi-thread chain stitches, thereby the string member is linearly drawn and a shape of loops of the needle thread crossing the string member is deformed. As a result, in the present invention, each loop formed with the needle thread can be crossed twice on the outer peripheral surface of the string member which is linearly drawn, thereby the string member can be firmly and stably fixed linearly at the tape side edge portion of the tape member without being pierced with the needle thread.

Therefore, the core string portion bulging in a top and back direction can be easily and efficiently formed at the tape side edge portion of the tape body, and the tape member according to the present invention as mentioned above can be stably manufactured. Further, since the sewing machine needle and a looper of a sewing machine conduct multi-thread chain stitching and fix the string member, the string member can be fixed by machine sewing continuously and for longer distance in the tape length direction, compared with a case forming lock stitches which requires exchanging the bobbin thread, for example.

MODES FOR CARRYING OUT THE INVENTION

Hereinafter, modes for carrying out the invention will be described in detail showing embodiments with reference to the drawings. It should be noted that the present invention is not limited to the embodiments explained as below, and various changes can be made as long as having a substantially same structure as and similar functional effects to the present invention.

For example, explained in each Embodiment below is a case that a plurality of synthetic resin fastener elements are attached to a tape side edge portion of a tape member by injection molding. However, it is also possible that the fastener stringer and the slide fastener are formed by attaching metal fastener elements to the tape side edge portion of the tape member instead of the synthetic resin fastener elements. In this case, the metal fastener elements are fixed to the tape side edge portion of the tape member such that the tape side edge portion of the tape member is inserted in the both leg portions of the fastener elements and the leg portions of the fastener elements are pressed toward the tape side edge portion to be plastically deformed.

Embodiment 1

Figure 1:
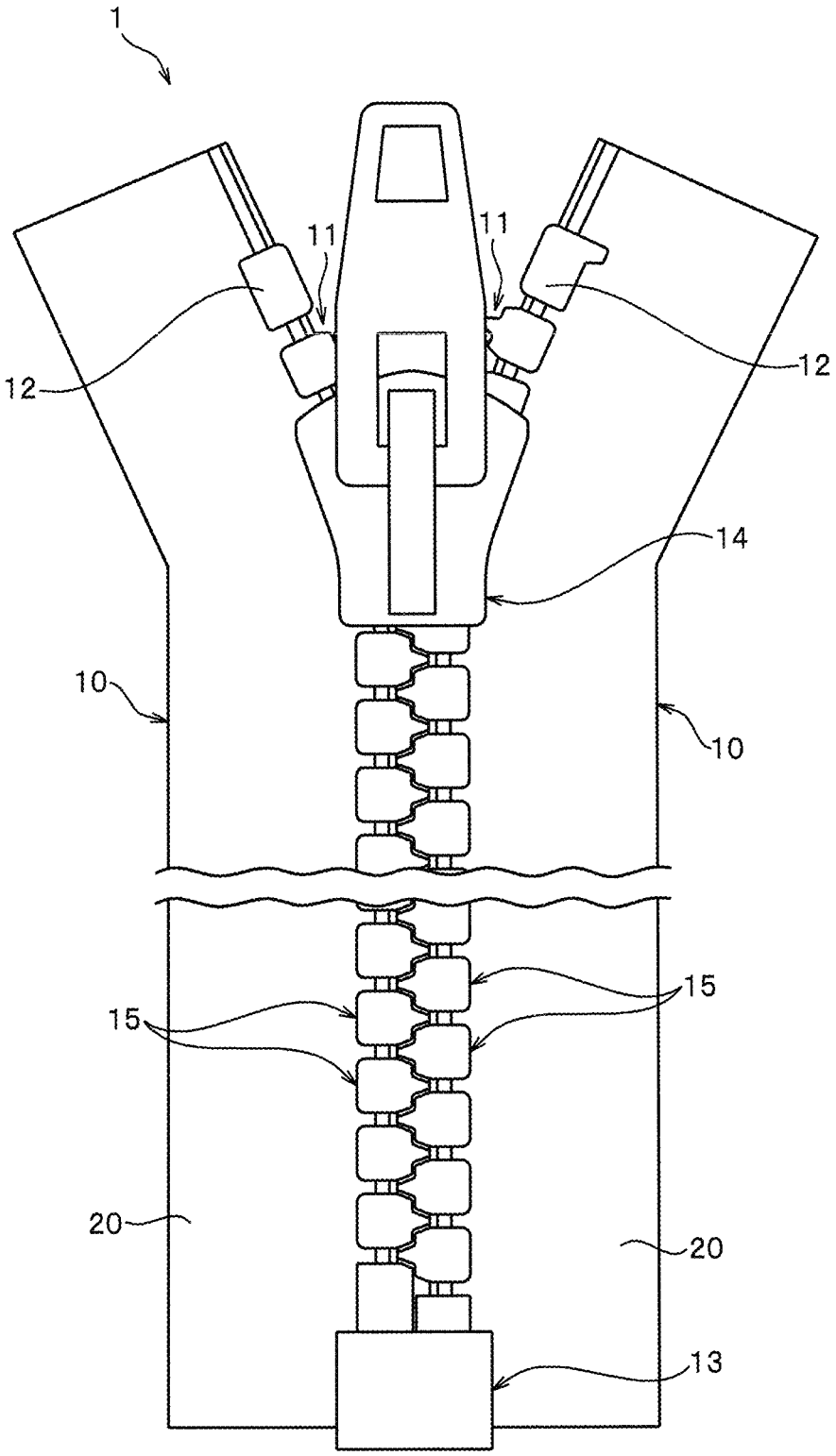
FIG. 1 is a plan view illustrating a slide fastener according to Embodiment 1 of the present invention.
Figure 2:
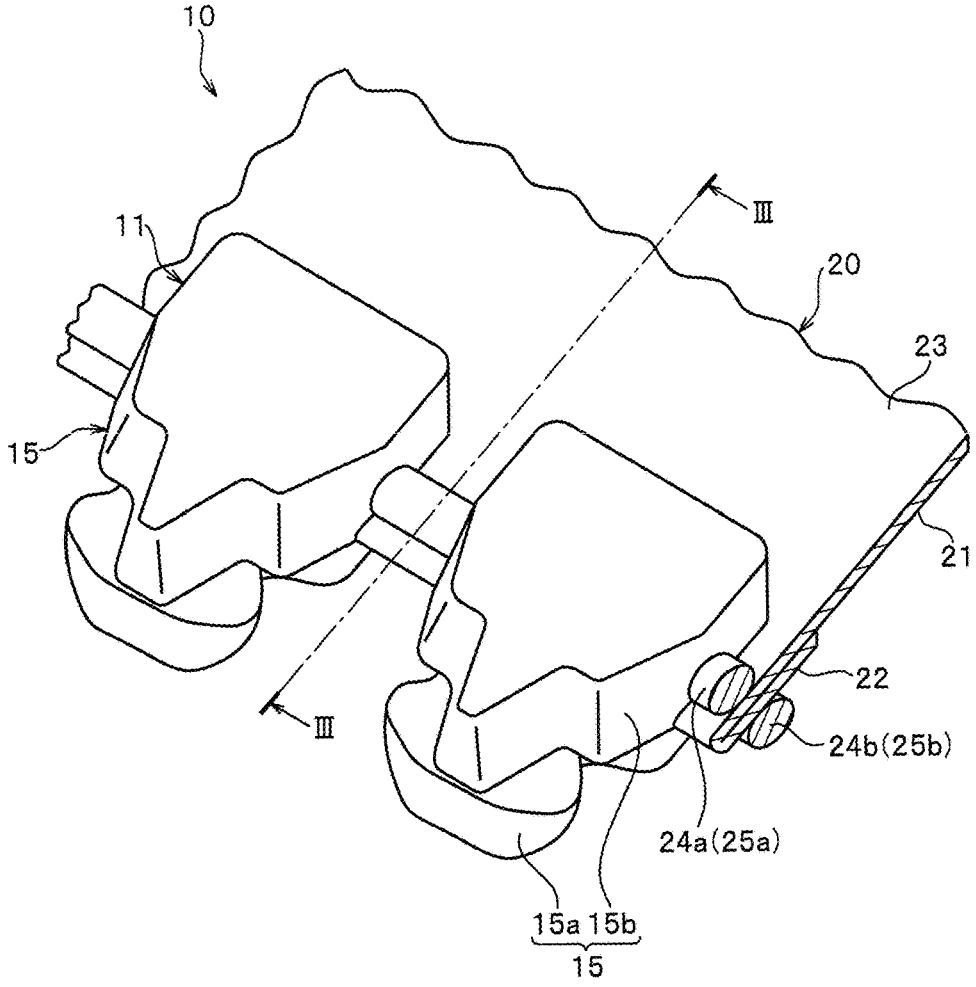
FIG. 2 is a perspective view illustrating an enlarged main part of a fastener stringer in the slide fastener.
Figure 3:
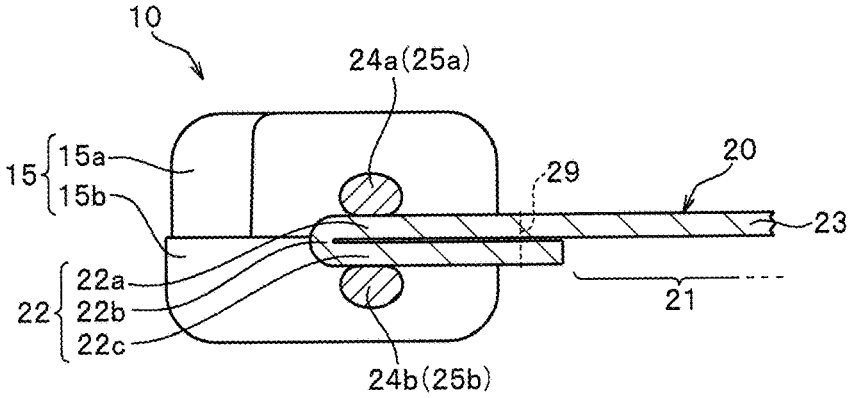
FIG. 3 is a cross-sectional view along the III-III line shown in FIG. 2.
Figure 4:
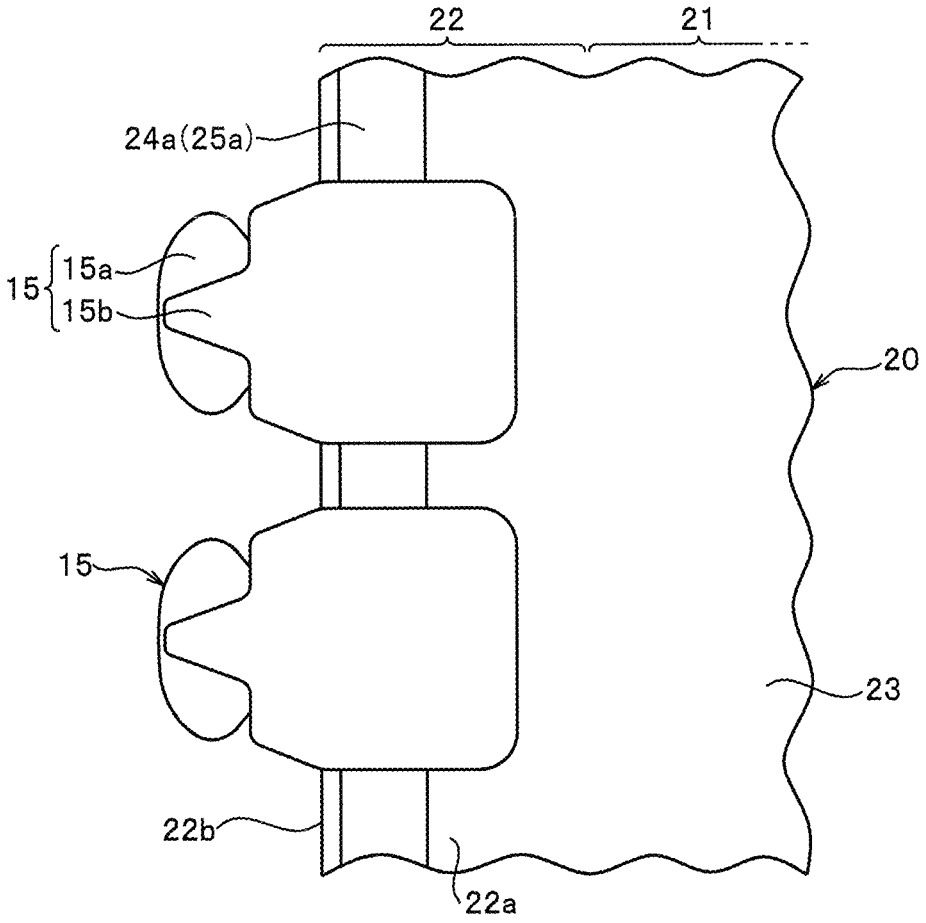
FIG. 4 is a plan view of the fastener stringer.
Figure 5:
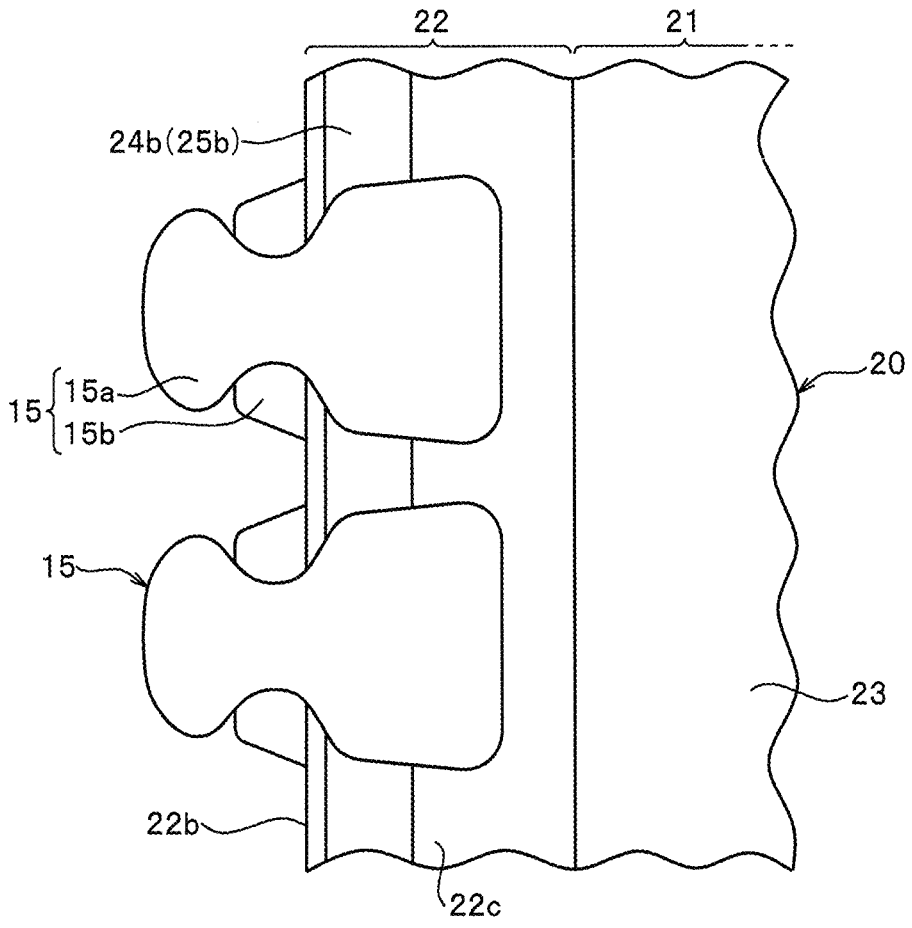
FIG. 5 is a bottom view of the fastener stringer.

FIG. 1 is a plan view illustrating a slide fastener according to Embodiment 1. FIG. 2 is a perspective view illustrating an enlarged main part of a fastener stringer in the slide fastener, and FIG. 3 is a cross-sectional view along the III-III line shown in FIG. 2. FIGS. 4 and 5 are a plan view and a bottom view illustrating a main part of the fastener stringer. It should be noted that in FIGS. 2 to 5, needle thread is not shown.

In the following descriptions, a front and rear direction is defined as a tape length direction of the tape member, as same as a sliding direction in which the slider slides, and particularly, a direction in which the slider slides to close the slide fastener is defined as the front direction, and a direction in which the slider slides to open the slide fastener is defined as the rear direction.

A right and left direction is defined as a tape width direction of the tape member, which is a direction perpendicular to the length direction and top and back direction of the tape member. Further, an upper and lower direction is defined as a tape top and back direction of the tape member. Particularly, a direction of a slide fastener in use exposed outside (a direction in which a tab of the slider is disposed with respect to the tape member) means an upper direction, and an opposite direction thereto means a lower direction.

The slide fastener 1 according to Embodiment 1 has, as shown in FIG. 1, a right and left pair of fastener stringers 10 on which element row 11 is formed along each tape side edge portion 22 of right and left tape members 20 facing to each other, right and left first end stops 12 (also referred to as upper end stops) disposed adjacent to the element row 11 at a front end part of each fastener stringer 10, a separable rear end stop 13 disposed adjacent to the element row 11 at a rear end part of the pair of fastener stringers 10 and a slider 14 attached to the element rows 11 and capable of sliding along the element rows 11.

In the slide fastener 1 of Embodiment 1, the tape member 20 of the fastener stringer 10 has waterproof property, and is formed as a water repellent fastener which suppresses intrusion of liquid to a back surface side from a top surface side of the tape member 20. The separable rear end stop 13 of Embodiment 1 has an insert pin disposed adjacent to the element row 11 at the rear end part of the left side tape member 20, a box pin disposed adjacent to the element row 11 at the rear end part of the right side tape member 20 and a box body formed integrally with the box pin at the rear end part of the box pin and capable of inserting the insert pin therein.

The first end stop 12, the separable rear end stop 13 and the slider 14 in the slide fastener 1 of Embodiment 1 are formed as same as a first end stop, a separable rear end stop and a slider generally used for a conventional water repellent fastener. Therefore, they are not explained in detail here. In the present invention, it is also possible that instead of the separable rear end stop 13, the second end stop (also referred to as lower end stop) formed bridging the right and left tape members 20 is provided adjacent to the element rows 11.

The right and left fastener stringers 10 respectively have a tape member 20 having a narrow band shape and an element row 11 formed along the tape side edge portion 22 of the tape member 20 facing to its counterpart. The element row 11 is formed such that a plurality of synthetic resin fastener elements 15 are provided at regular intervals by injection molding at the tape side edge portion 22.

The fastener element 15 of Embodiment 1 has a similar shape to a fastener element disposed on conventional general water repellent fastener, for example.

Explaining briefly, the fastener element 15 of Embodiment 1 has a first element portion 15*a* disposed on the tape back surface side of the tape member 20 and a second element portion 15*b* disposed on the tape top surface side of the tape member 20 and having a different shape from a shape of the first element portion 15*a*.

The tape top surface (member top surface) of the tape member 20 here means, as mentioned later, a surface (upper surface) facing upward and exposed outside in a state that the second tape fixing portion 22*c* of the tape side edge portion 22 in the tape member 20 is folded back, and the folded shape of the tape side edge portion 22 is held with a tape sewing line 29. The tape back surface (member back surface) of the tape member 20 means a surface which is disposed on an opposite side of the tape top surface and facing downward (lower surface) in a state that the folded shape of the above-mentioned second tape fixing portion 22*c* is held.

The first element portion 15*a* of the fastener element 15 has a first body portion fixed to the tape member 20, a neck portion formed continuously from the first body portion and having a constricted shape and an oval-shaped coupling head portion formed continuously from the neck portion.

The second element portion 15*b* has a second body portion having a substantially rectangular parallelepiped shape and fixed to the tape member 20 and an element head portion extending from the second body portion in the tape width direction so as to protrude from facing side edges in the tape of the tape member 20. The element head portion of the second element portion 15*b* has a shape that a dimension in the tape length direction is decreased gradually in two stages toward a tip end of the element head portion. The shape of the fastener element 15 is not limited in the present invention but can be changed arbitrarily.

The tape member 20 of Embodiment 1 has a tape body 23 formed by cutting a thin cloth having flexibility, waterproof property and moisture permeability in a narrow width shape and first and second core string portions 24*a*, 24*b* provided at the tape side edge portion 22 of the tape body 23 along the tape length direction. In this case, the first core string portion 24*a* is provided at the member top surface of the tape member 20 to bulge upward from the tape body 23, and the second core string portion 24*b* is provided at the member back surface of the tape member 20 to bulge downward from the tape body 23.

The tape body 23 which configures the tape member 20 is formed by preparing a thin cloth having waterproof property and moisture permeability and cutting the cloth in a narrow width shape (or a desired shape). As an example of the thin cloth having waterproof property and moisture permeability as mentioned above, Gore-Tex (registered trademark) can be used.

In the present invention, it is also possible that the tape body 23 is formed using a cloth having not waterproof property and moisture permeability as mentioned above but other properties such as water absorption (sweat absorption) and quick dry property, heat storage performance or anti-fouling property, or is formed using materials other than cloth such as natural leather from animal and synthetic leather.

The tape member 20 of Embodiment 1 has a tape main body portion 21 to be sewn to a fastener attached product such as clothing items and bags and a tape side edge portion 22 extending from one side edge of the tape main body portion 21 in the tape width direction and having a first and second core string portions 24*a*, 24*b*. A plurality of fastener elements 15 are formed by injection molding in the tape side edge portion 22 in a state that the first and second core string portions 24*a*, 24*b* are provided. Therefore, the tape side edge portion 22 is also referred to as an element attaching portion in some cases.

It should be noted that although the tape member 20 of Embodiment 1 has a narrow width shape as mentioned above, it is also possible to manufacture a slide fastener by using a cloth (garment cloth) constituting a part of a fastener attached product such as clothing items to be as the tape member, and directly forming a plurality of fastener elements 15 to the garment cloth by injection molding.

In this case, the tape member (or tape body) is not a narrow width shape but a shape corresponding to constituent parts used for the fastener attached product. In a case that the plurality of fastener elements 15 are directly formed to the garment cloth (constituent part of front placket) forming a front placket portion of a clothing item, for example, the tape body of the tape member to which the fastener elements 15 are formed is formed by cutting a cloth having a desired property (waterproof property and moisture permeability, for example) not in a narrow width shape but a shape corresponding to the constituent part of the front placket portion. Thereby, it is possible to obtain a flexible and lightweight slide fastener having a feeling of unity with the fastener attached product such as clothing items.

Figure 8:
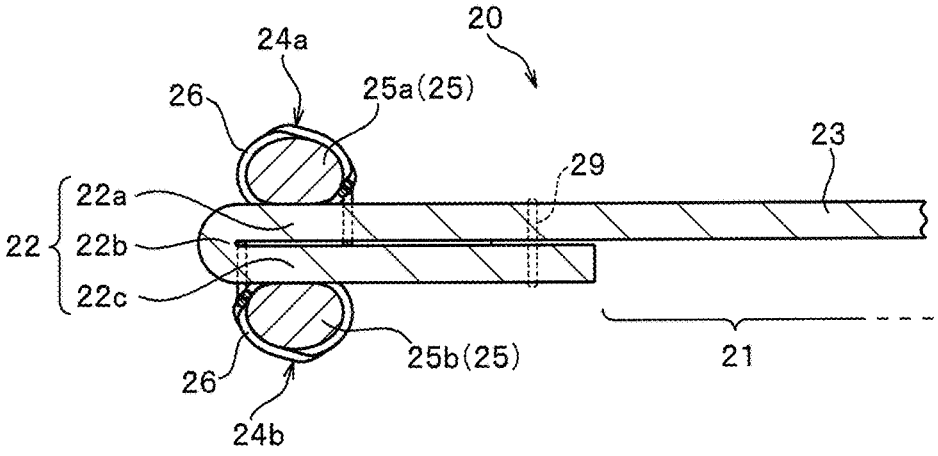
FIG. 8 is a cross-sectional view illustrating the tape side edge portion in a state that the second tape fixing portion is folded back and sewn to the first tape fixing portion in the tape member.

In Embodiment 1, the tape side edge portion 22 of the tape member 20 has, as shown in FIG. 8, a first tape fixing portion 22*a* disposed continuously from the tape main body portion 21 in the tape width direction and on which the first core string portion 24*a* is formed, a folded portion 22*b* extending from the first tape fixing portion 22*a* and folded in a substantially U-shape on the member back surface side, and a second tape fixing portion 22*c* extending from the folded portion 22*b* toward a tape inside. A second tape fixing portion 22*c* is overlapped on the first tape fixing portion 22*a* and sewn to the first tape fixing portion 22*a* with a tape sewing line 29.

The tape side edge portion 22 of Embodiment 1 has a first tape surface which is an inner surface facing to each other when the second tape fixing portion 22*c* is overlapped with the first tape fixing portion 22*a*, and a second tape surface forming the member top surface and the member back surface of the tape side edge portion 22.

The first tape surface and the second tape surface mentioned here mean one tape surface and the other tape surface which the tape body 23 has, in a state that the tape body 23 is flat (a state before the second tape fixing portion 22*c* is folded), and particularly, when a sewing processing is conducted to fix a string member 25, described later, with respect to the tape body 23, the first tape surface means a tape surface facing upward when a sewing machine needle 5 pierces and on which a needle thread 26 runs along a tape length direction. The second tape surface means a tape surface on a side that loops of the needle thread 26 are formed with the pierced sewing machine needle 5. In the tape body 23 of Embodiment 1, the second tape surface becomes a tape surface on the side the string member 25 is fixed.

Therefore, in the tape side edge portion 22 of Embodiment 1, the second tape fixing portion 22*c* is sewn to the first tape fixing portion 22*a* to be folded so that the second tape surface of the tape side edge portion 22 faces an outside and the first tape surface forms an inner peripheral surface via the folded portion 22*b*.

In this case, a part of the first tape fixing portion 22*a* close to the tape main body portion 21 and a part close to a tip end of the second tape fixing portion 22*c* (a part close to the tape side end edge which becomes a cut edge of the tape body 23) are sewn to each other with the tape sewing line 29 in a state that the first and second tape fixing portions 22*c* are overlapped.

The first core string portion 24*a* of Embodiment 1 is provided linearly on the member top surface (second tape surface) of the first tape fixing portion 22*a* in the tape side edge portion 22 along the tape length direction, and the second core string portion 24*b* is provided linearly on the member back surface (second tape surface) of the second tape fixing portion 22*c* in the tape side edge portion 22 along the tape length direction.

Figure 9:
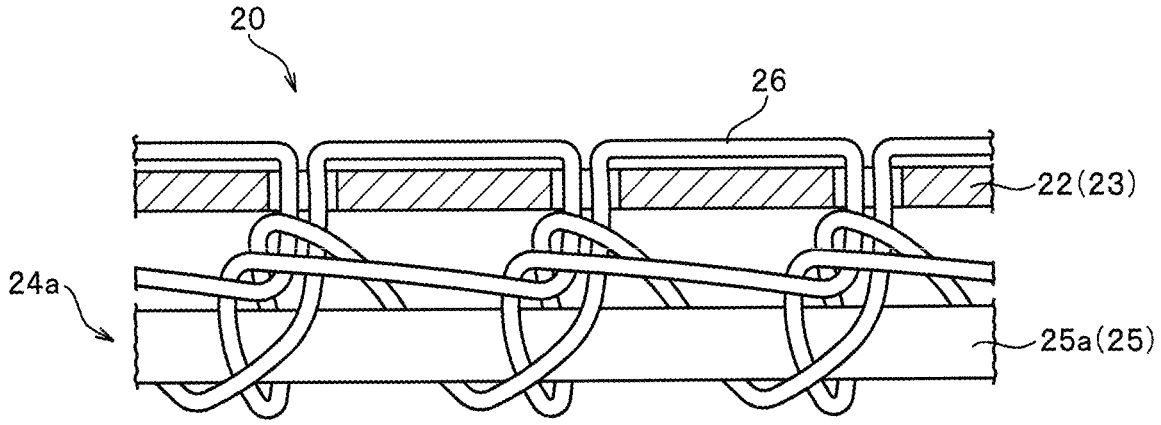
FIG. 9 is a schematic view illustrating a state schematically that the string member is linearly fixed to the tape side edge portion of the tape member with a needle thread.

The first and second core string portions 24*a*, 24*b* are formed respectively such that one string member 25 formed of an airy bulky twisted yarn is disposed linearly along the tape length direction, and the string member 25 is fixed with one needle thread 26, as the structure of the first core string portion 24*a* is schematically shown in FIG. 9, for example. It should be noted that in FIG. 9, respective intervals between the tape side edge portion 22 of the tape body 23, the string member 25 and the needle thread 26 are shown larger, and crossing of the needle thread 26 itself is shown loosened, compared with the actually formed first core string portion 24*a* in order to show the structure of the first core string portion 24*a* to be more understandable.

In the first and second core string portions 24*a*, 24*b* of Embodiment 1, the needle thread 26 forms constant stitch patterns repeatedly in the tape length direction, and the loops of the needle thread 26 interloop each string member 25 forming the first and second core string portion 24*a*, 24*b*. Thereby the needle thread 26 fastens and fixes the string member 25 to the tape side edge portion 22 without piercing the string member 25, as shown in FIG. 9.

In this case, a thickness of each string member 25 forming the first and second core string portions 24*a*, 24*b* can be chosen arbitrary depending on a size and a shape of the fastener element 15 formed on the tape member 20.

In the case of Embodiment 1, the first string member 25*a* forming the first core string portion 24*a* and the second string member 25*b* forming the second core string portion 24*b* have the same thickness. However, in the present invention, it is also possible to change the thickness of the first string member 25*a* and that of the thickness of the second string member 25*b*.

A string member 25 having an arbitrary color can be used for the first and second string members 25*a*, 25*b* of Embodiment 1. That is, in Embodiment 1, colors can be selected for the tape body 23, the first and second string members 25*a*, 25*b*, the needle thread 26 and the fastener element 15, respectively. Therefore, designs of the slide fastener 1 can be varied, and design property of the fastener attached products can be effectively enhanced.

As the needle thread 26 of Embodiment 1, a thread thinner than the string member 25 forming the first and second core string portions 24*a*, 24*b* is used. This needle thread 26 runs on the first tape surface of the tape side edge portion 22, and pierces the tape body 23 from the first tape surface to the second tape surface at regular intervals and form one loop on the second tape surface per pierced stitch. Further, each loop formed with the needle thread 26 does not pierce the bulky string member 25, but crosses the outer peripheral surface of the string member 25 twice while contacting it on the second tape surface side of the tape side edge portion 22.

Since the needle thread 26 forms a loop shape (stitch) as mentioned above, the string member 25 drawn linearly is firmly fixed to the tape side edge portion 22 with a needle thread 26 so as not to move in the tape length direction or the tape width direction. The outer peripheral surface of the string member 25 means a peripheral surface of the string member 25 on a side disposed opposite to the inner peripheral surface contacting the tape body 23 and exposed outside.

The method to manufacture the tape member 20 as shown in FIG. 8 by preparing the tape body 23 cut in a narrow width shape and forming the first and second core string portions 24*a*, 24*b* on the tape side edge portion 22 of the tape body 23 will be described referring to FIGS. 6 to 13.

Figure 6:
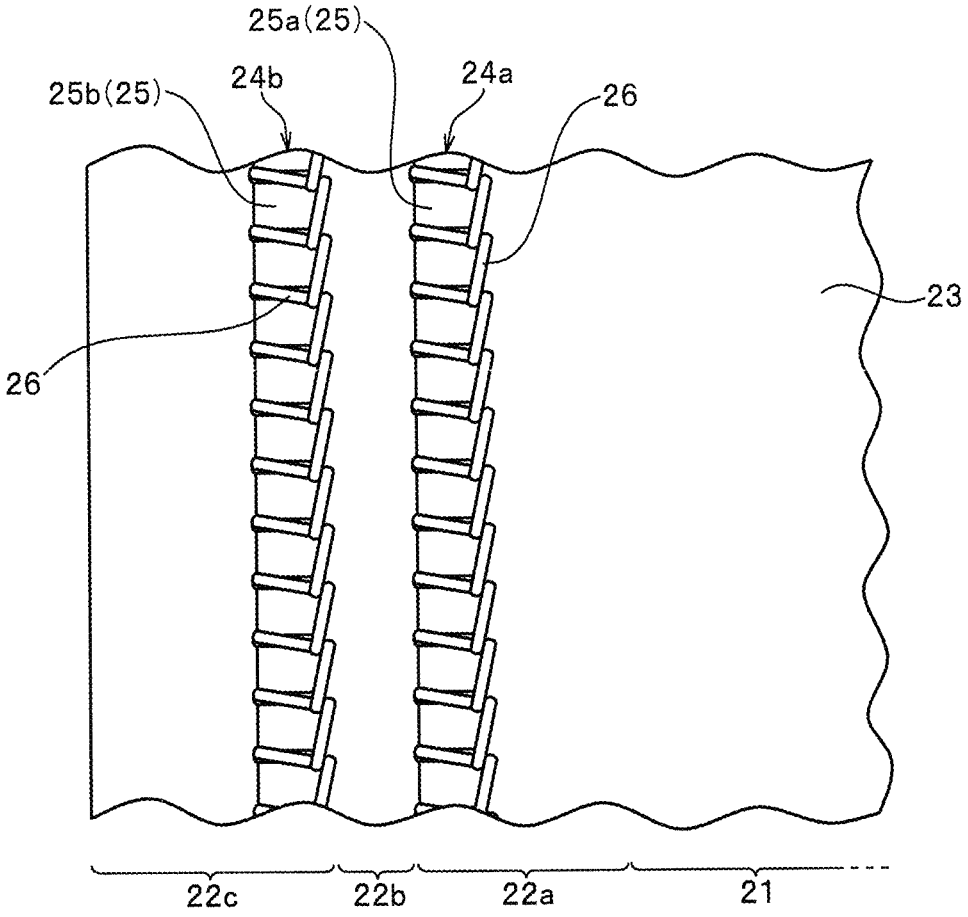
FIG. 6 is a plan view illustrating a tape side edge portion before a second tape fixing portion is folded back in the tape member of Embodiment 1.
Figure 7:
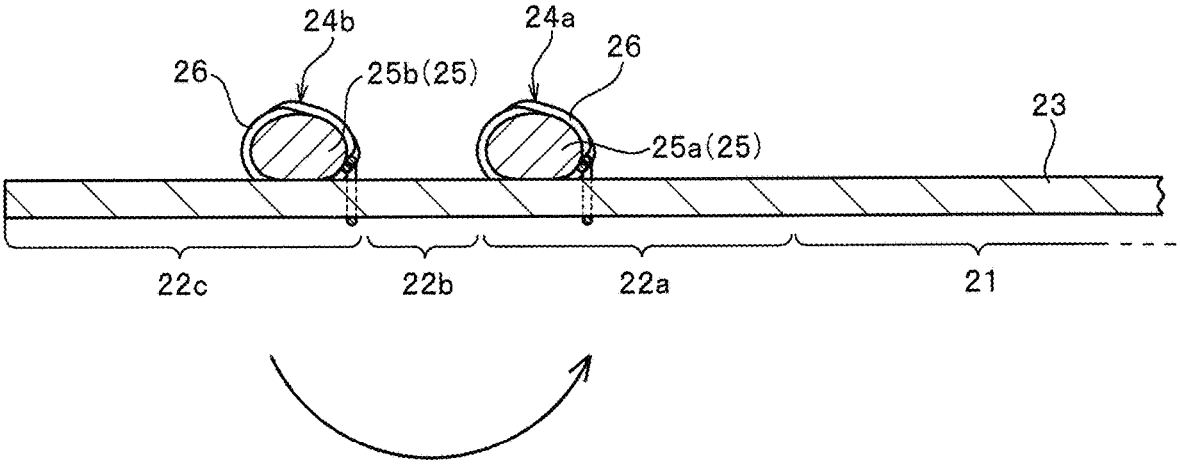
FIG. 7 is a cross-sectional view illustrating the tape side edge portion before the second tape fixing portion is folded back in the tape member.

First, the first and second core string portions 24*a*, 24*b* are formed on the second tape surface of the tape side edge portion 22 in the prepared narrow width tape body 23. In this case, as shown in FIGS. 6 and 7, the first and second string members 25*a*, 25*b* are fixed linearly and parallel to each other along the tape length direction to the flat tape body 23 before the second tape fixing portion 22*c* is folded with respect to the first tape fixing portion 22*a* of the tape side edge portion 22 by machine sewing.

The first string member 25*a* is fixed on the second tape surface of the first tape fixing portion 22*a* of the tape side edge portion 22 with the needle thread 26, and the second string member 25*b* is fixed on the second tape surface of the second tape fixing portion 22*c* of the tape side edge portion 22 with the needle thread 26.

In Embodiment 1, when the first and second string members 25*a*, 25*b* are respectively fixed to the first and second tape fixing portions 22*a*, 22*b* of the tape side edge portion 22 by machine sewing, a sewing machine having a sewing machine needle 5 and a looper 6 conducting multi-thread chain stitching, and the first and second string members 25*a*, 25*b* as a looper thread (lower thread) are respectively used, and sewing processing is conducted as described later.

As a sewing machine used for fixing the first and second string members 25*a*, 26*b* in Embodiment 1, a multi-thread chain stitch sewing machine in which the sewing machine needle 5 and the looper 6 form multi-thread chain stitches designated as symbol 401 in L0120-1984 of Japan Industrial Standard (JIS) is used.

In the following explanations, a case will be explained that the first string member 25*a* is fixed to the first fixing portion 22*a* of the tape side edge portion 22 to form the first core string portion 24*a*. However, in Embodiment 1, also in the case of forming the second core string portion 24*b* by fixing the second string member 25*b* to the second tape fixing portion 22*c* of the tape side edge portion 22, the same sewing processing as the case of the first core string portion 24*a* is conducted.

In a case of fixing the first string member 25*a* to the first tape fixing portion 22*a* of the tape side edge portion 22 by sewing processing, the sewing processing is conducted such that, as shown in FIGS. 10 to 13, the sewing machine needle 5 to which the needle thread 26 is threaded is moved in an upper and lower direction, and the tape side edge portion 22 of the tape body 23 is fed intermittently toward a downstream side (rearward) at a predetermined feeding amount in accordance with the move of the sewing machine needle 5 while the looper 6 repeats moving forward and rearward at predetermined timing on the back surface side of a needle plate.

Figure 10:
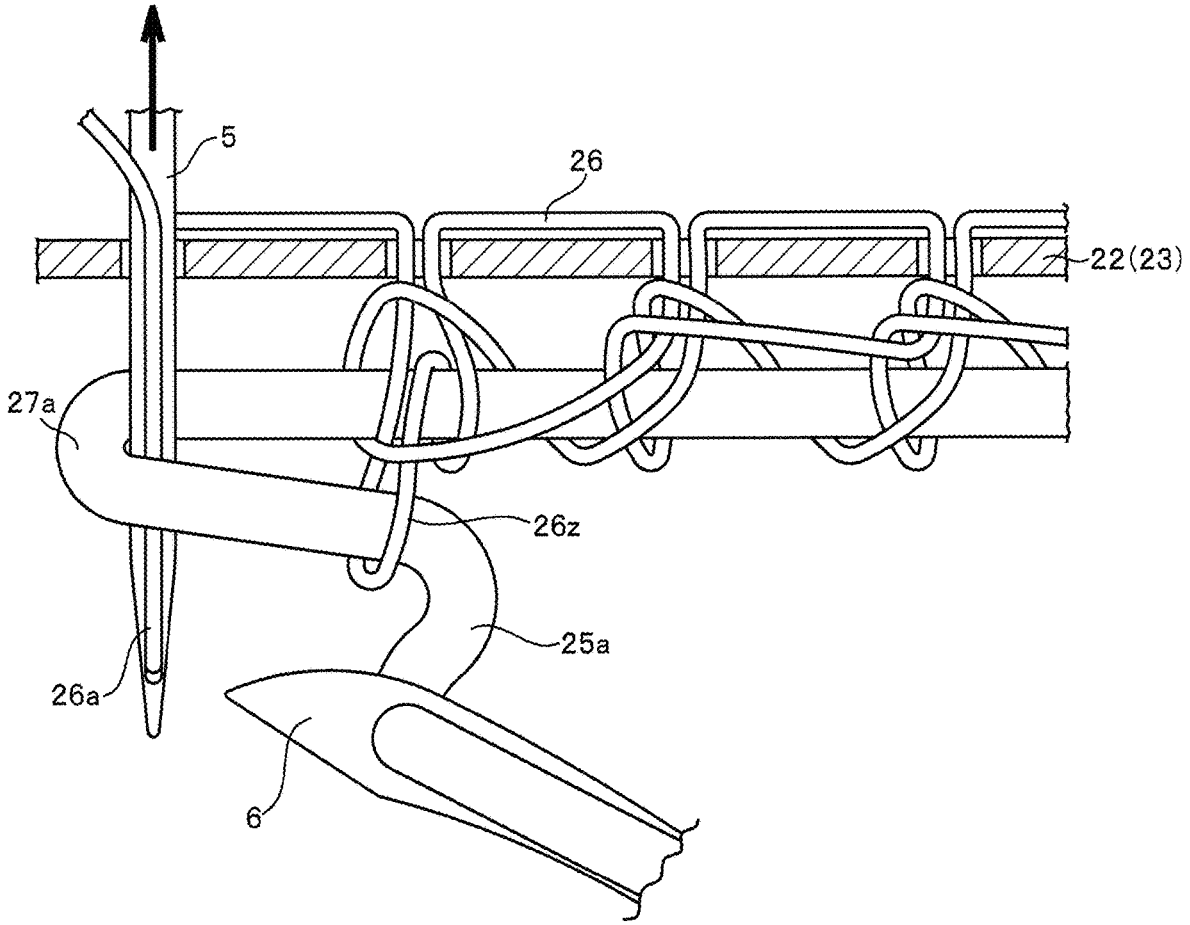
FIG. 10 is a schematic view illustrating a state that the needle thread pierces the tape side edge portion and passes through a loop of the string member (looper thread) in machine sewing for fixing the string member.

More specifically, the sewing machine needle 5 descends and pierces the tape side edge portion 22 of the tape body 23 from the first tape surface to the second tape surface, as shown in FIG. 10, for example, and further, the sewing machine needle 5 passes through a loop 27*a* of the first string member 25*a* (looper thread) formed as the looper moves rearward, and moves to the lowest position of the needle.

Figure 11:
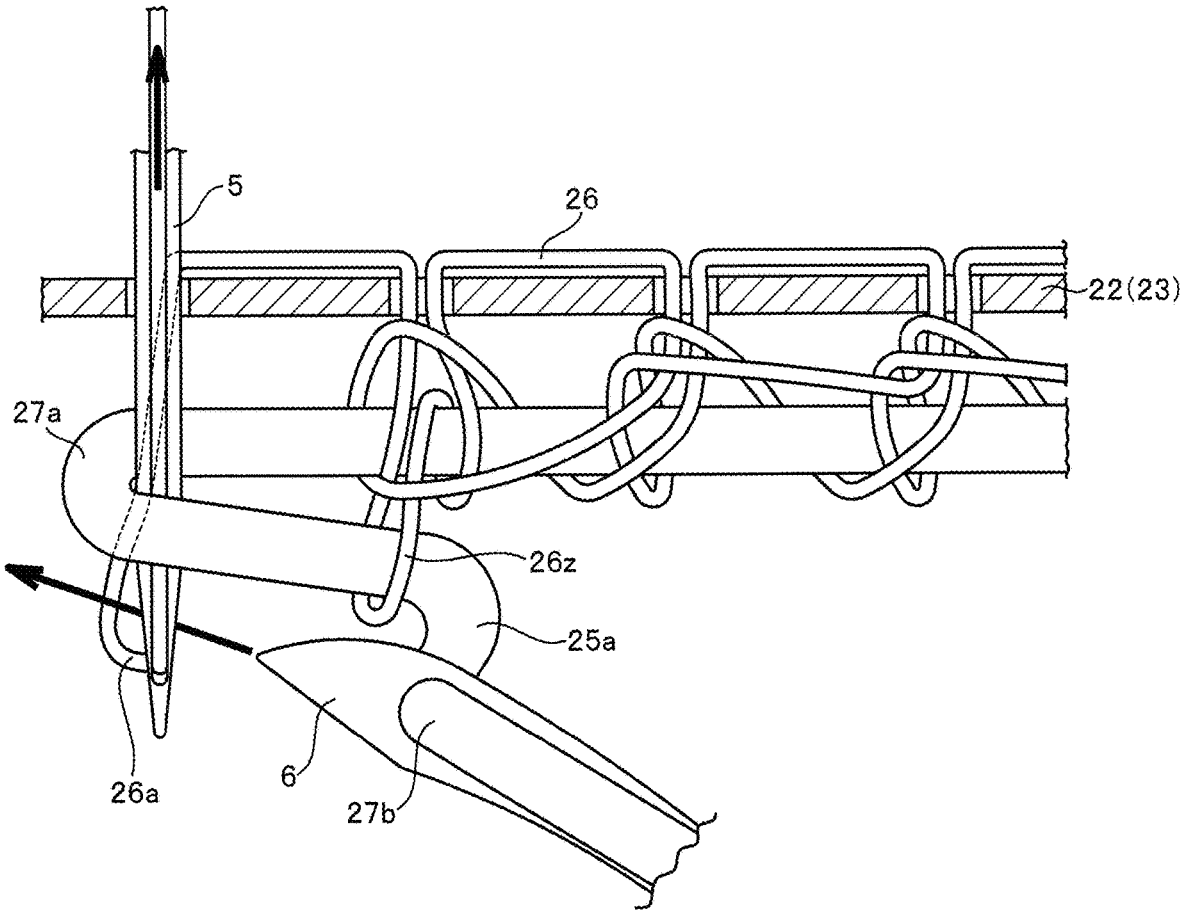
FIG. 11 is a schematic view illustrating a state in machine sewing that the sewing machine needle moves upward a little from the state of FIG. 10.

Subsequently, the sewing machine needle 5 starts ascending from the lowest position of the needle. As the sewing machine needle 5 ascends, the loop 26*a* of the sewing thread 26 loosens (swells up) at a tip end part of the sewing machine needle 5, as shown in FIG. 11. Further, the looper 6 standing by at a predetermined stand-by position moves forward to pass through the loosened loop 26*a* of the needle thread 26 while holding the first string member 25*a* at the tip end part, and the looper 6 scoops the loop 26*a* of the needle thread 26 (in other words, a next loop 27*b* of the first string member 25*a* interloops with the loop 26*a* of the needle thread 26). At the same time, the sewing machine needle 5 further ascends in a state that a loop 26*a* of the needle thread 26 is hooked with the looper 6, and moves above the tape side edge portion 22. At this time, the needle thread 26 is tightened by applying tension to the needle thread 26.

Figure 12:
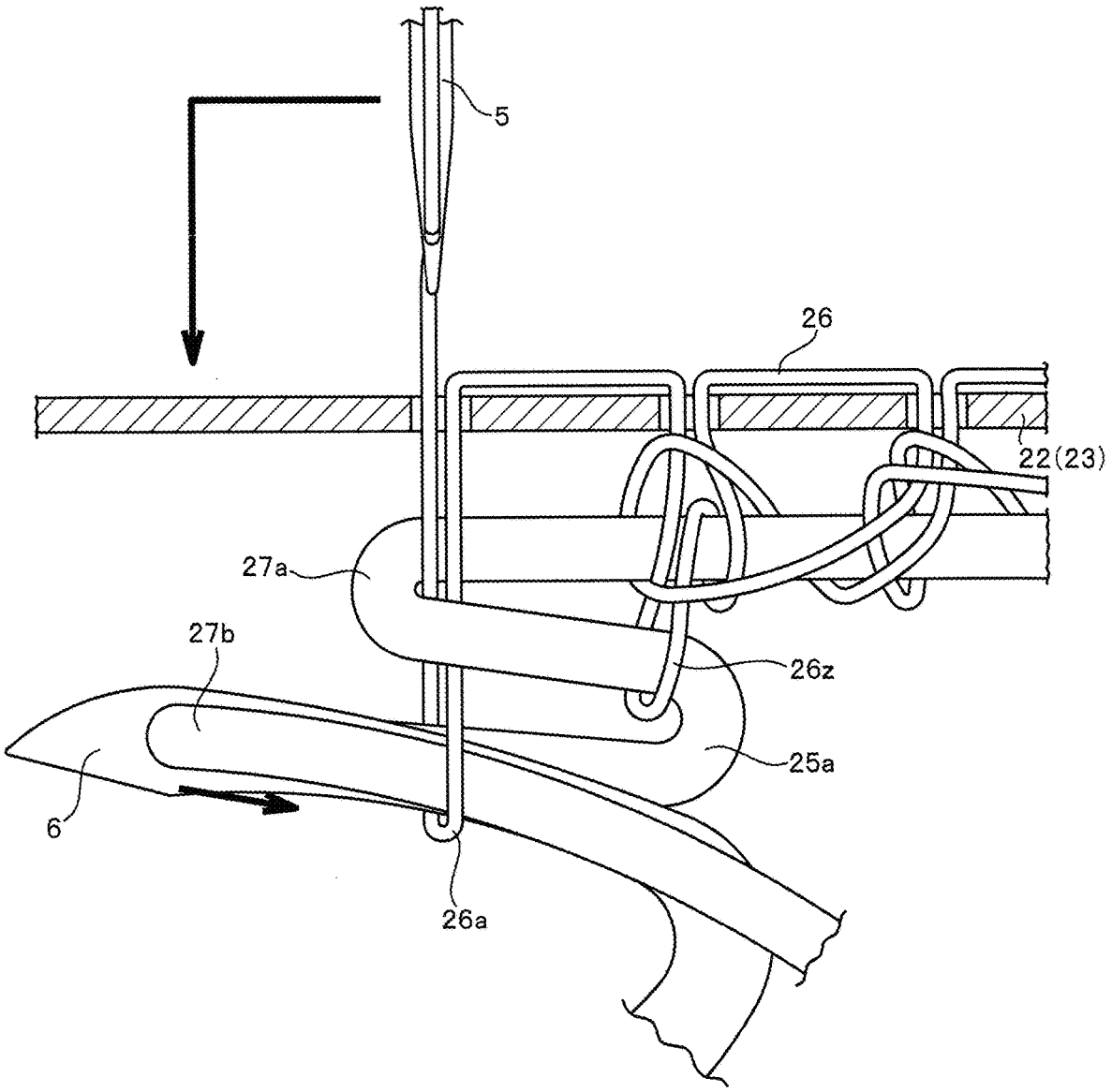
FIG. 12 is a schematic view illustrating a state in machine sewing that the sewing machine needle further moves upward from the state of FIG. 11 and the looper holding the string member passed through the loop of the needle thread.

Thereby, as shown in FIG. 12, the loop 26*a* of the needle thread 26 formed on a side of the second tape surface side of the tape side edge portion 22 approaches the tape side edge portion 22 and passes through the loop 27*a* of the first string member 25*a* which has been already formed, and the loop 27*b* which is formed followed by the first string member 25*a* passes through the tip end part of the loop 26*a* of the needle thread 26.

Next, as indicated by an arrow in FIG. 12, the tape side edge portion 22 of the tape body 23 moves to the downstream side by feeding operation of the sewing machine, thereby the sewing machine needle 5 moves forward relative to the tape side edge portion 22, and the sewing machine needle 5 starts descending and pierces the tape side edge portion 22. Further, the looper 6 after passing through the loop 26*a* of the needle thread 26 moves rearward in accordance with the movement of the tape side edge portion 22. At this time, the loop 27*b* of the first string member 25*a* is loosened at the tip end part of the looper 6, as shown in FIG. 13.

Thereafter, the sewing machine needle 5 after piercing the tape side edge portion 22 further descends, and a next loop 26*b* of the needle thread 26 which is formed on the second tape surface side of the tape side edge portion 22 passes through the loop 27*b* of the first string member 25*a* at the tip end part of the looper 6 (in other words, the loop 26*b* of the needle thread 26 interloops with the loop 27*b* of the first string member 25*a*). At the same time, the looper 6 moves rearward in a state that the loop 27*b* of the first string member 25*a* is hooked with the sewing machine needle 5, and the looper 6 exits from the loop 26*a* of the needle thread 26 which has been formed when the sewing machine needle 5 pierced the tape side edge portion 22 at one stitch before, and returns to the stand-by position.

Figure 13:
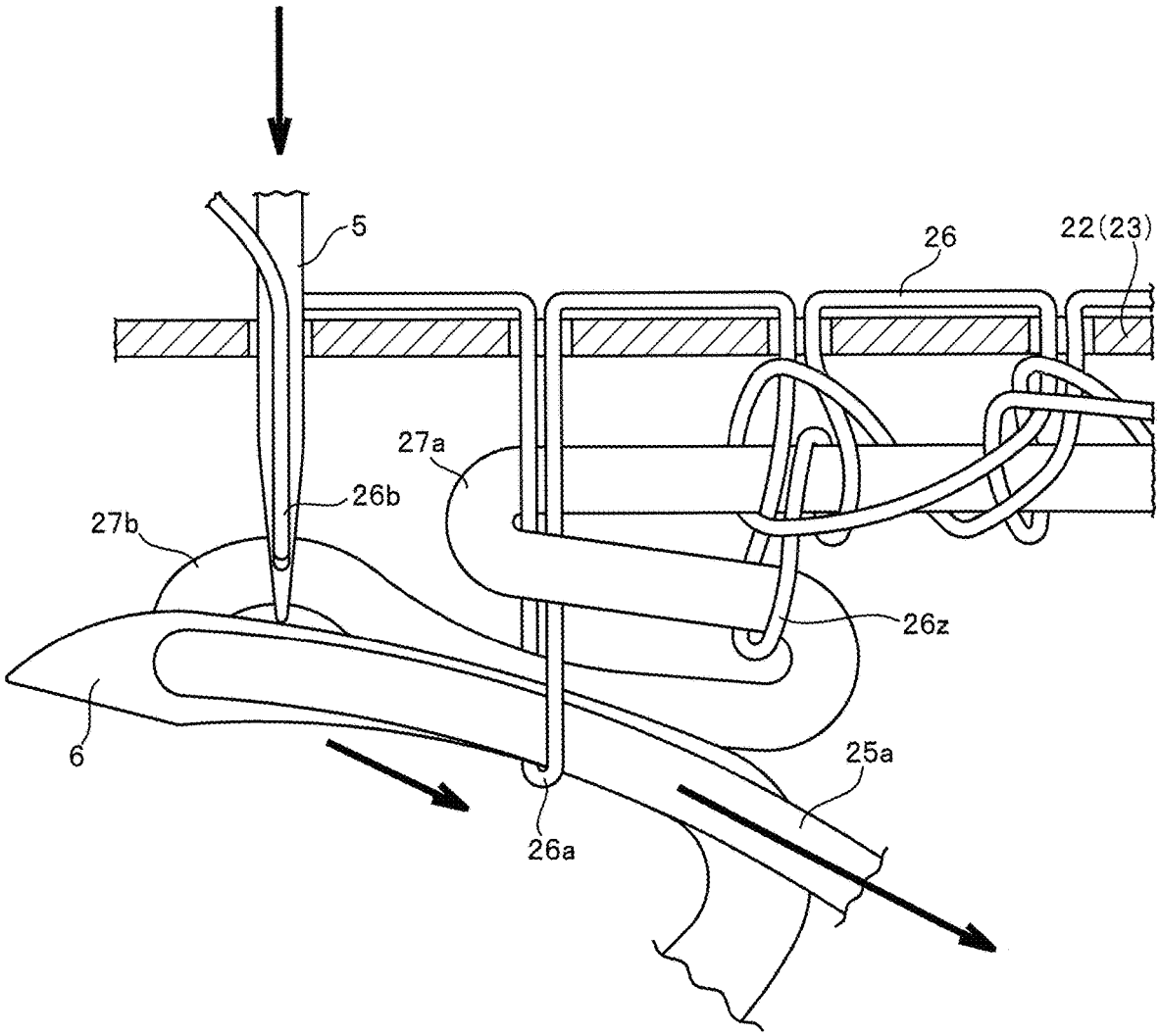
FIG. 13 is a schematic view illustrating a state in machine sewing that the tape body is fed rearward and the sewing machine needle moves downward and passes through the loop of the string member.

Further, along with the rearward movement of the looper 6, a tension-applying portion of the looper thread which is not shown pulls strongly and applies tension to the first string member 25*a* (looper thread) as shown in FIG. 13, thereby the first string member 25*a* within a range from the loop 27*a* at one stitch before in the first string member 25*a* to the sewing machine needle 5 piercing the tape side edge portion 22 is drawn straight, and the loop 26*a* at one stitch before in the needle thread 26 and the loop 26*z* at two stitch before in the needle thread 26 are deformed. Further at this time, the needle thread 26 can be tightened by applying tension to the needle thread 26 and twisted around the first string member 25*a*.

Thus, the needle thread 26 and the first string member 25*a* proceed to a state shown in FIG. 10. The loop 26*z* at two stitch before in the needle thread 26 interloops on the outer peripheral surface of the first string member 25*a* which is drawn straight so as to cross it twice while contacting it to tighten the first string member 25*a* (i.e. a state of the loop of the needle thread 26 at one stitch before the loop 26*z* shown in FIG. 10), and the first string member 25*a* is fixed with the loop 26*z* of the needle thread 26.

As mentioned above, the sewing machine needle 5 and the looper 6 of the sewing machine repeatedly conduct multi-thread chain stitching per stitch (per pitch of the sewing machine) in accordance with feeding operation of the sewing machine, and the tension is strongly applied to the first string member 25*a* intermittently coincide with the timing that the sewing machine needle 5 pierces the tape side edge portion 22, thereby the stitch of the ordinary multi-thread chain stitches is deformed, the first string member 25*a* is drawn linearly, and the loop of the needle thread 26 interloops with the linear-shaped first string member 25*a*.

As a result, it is possible that the needle thread 26 runs on the first tape surface of the tape side edge portion 22 and pierces the tape side edge portion 22 to form a loop per stitch on the second tape surface, and each loop of the needle thread 26 cross twice the outer peripheral surface of the first string member 25*a* which is linearly drawn and tighten the first string member 25*a*.

The stitches of the needle thread 26 as shown in FIG. 9 are thus formed, thereby the needle thread 26 can stably fix the linear-shaped first string member 25*a* on the second tape surface of the tape side edge portion 22 by interlooping of each loop of the needle thread 26 without piercing the first string member 25*a*, and can form the first core string portion 24*a*. In the formed first core string portion 24*a*, each loop of the needle thread 26 interloops with the first string member 25*a* so as to tighten the first string member 25*a*, thereby a position of the first string member 25*a* can be prevented from being misaligned in the tape length direction or the tape width direction.

Further in Embodiment 1, the second core string portion 24*b* can be formed simultaneously, before or after forming the first core string portion 24*a* by conducting the sewing processing with the multi-thread chain stitch sewing machine using the needle thread 26 and the second string member 25*b* similar to the case of the first core string portion 24*a*.

In forming the second core string portion 24*b*, stitches of the needle thread 26 is formed as shown in FIG. 9, thereby the needle thread 26 can stably fix the linear-shaped first string member 25*b* to the second tape surface of the tape side edge portion 22 by interlooping of each loop of the needle thread 26 along the tape length direction without piercing the second string member 25*b*.

And by forming the first and second core string portions 24*a*, 24*b* as above, the first string member 25*a* is linearly provided at the first tape fixing portion 22*a* of the tape side edge portion 22 along the tape length direction, and the second string member 25*b* is linearly provided at the second tape fixing portion 22*b* of the tape side edge portion 22 to be apart from and parallel to the first core string portion 24*a*, as shown in FIGS. 6 and 7. In this case, even when the tape body 23 has stretchability, the first and second string members 25*a*, 25*b* can be fixed straight in a linear shape to the tape side edge portion 22 of the tape body 23.

Accordingly in Embodiment 1, the first and second core string portions 24*a*, 24*b* can be formed at a later stage to the tape body 23 provided with a desired property which is waterproof property and moisture permeability without having a core string portion. In addition, defects such as misalignment of positions of the formed first and second core string portions 24*a*, 24*b* or moving of the first and second string members 25*a*, 25*b* in the tape length direction can be prevented.

Further in Embodiment 1, the string member 25 does not need to be prepared and guided separately from the needle thread and the looper thread of the sewing machine at the time of machine sewing, and the first core string portion 24*a* or the second core string portion 24*b* can be formed by sewing only once. Therefore, the first and second core string portions 24*a*, 24*b* can be formed easily and efficiently. Further, increase of cost such as facility cost can be suppressed because a conventional general multi-thread chain stitch sewing machine can be used instead of a specially structured sewing machine conducting special movement.

Then, after the first and second core string portions 24*a*, 24*b* are formed at the tape side edge portion 22 of the tape body 23 along the tape length direction as above (see FIGS. 6 and 7), the second tape fixing portion 22*c* of the tape side edge portion 22 on which the second core string portion 24*b* is formed is folded in the tape width direction and overlapped with respect to the first tape fixing portion 22*a* on which the first core string portion 24*a* is formed based on an intermediate position between the first core string portion 24*a* and the second core string portion 24*b* so that the first tape surface on which the needle thread 26 of the tape side edge portion 22 runs faces inward, as shown in FIG. 8, for example. Thereby, a folded portion 22*b* between the first tape fixing portion 22*a* and the second tape fixing portion 22*c* is folded in a substantially U-shape.

Further, the first tape fixing portion 22*a* and the second tape fixing portion 22*c* which are overlapped are sewn at a position on a tape inside further than the first and second string members 25*a*, 25*b* (a position close to the tape main body portion 21). At this time, in Embodiment 1, the first tape fixing portion 22*a* and the second tape fixing portion 22*c* are sewn along the tape length direction using a multi-thread chain stitch sewing machine. Therefore, the tape sewing line 29 of the multi-thread chain stitches is formed at a position between the first and second string members 25*a*, 25*b* and the tape main body portion 12 along the first and second string members 25*a*, 25*b*.

The first tape fixing portion 22*a* and the second tape fixing portion 22*c* are sewn with the tape sewing line 29 as above, thereby the tape member 20 of Embodiment 1 in which the first core string portion 24*a* is disposed on the member top surface of the tape side edge portion 22 so as to bulge upward, and the second core string portion 24*b* is disposed on the member back surface of the tape side edge portion 22 so as to bulge downward, as shown in FIGS. 2 and 3, is manufactured.

In the tape member 20 of Embodiment 1 thus manufactured, the second tape fixing portion 22*c* is sewn to the first tape fixing portion 22*a* in a folded state. Therefore, even when the tape side edge end of the second tape fixing portion 22*c* remains unprocessed after cut (cut edge state), for example, the unprocessed tape side edge end is folded back on the member back surface side of the tape member 20 and is not exposed on a side surface part of the right and left tape members 20 facing to each other in the slide fastener 1.

Therefore, the unprocessed side edge end of the tape body 23 is less likely to be seen from an outside (particularly, on the upper surface side of the slide fastener), and an appearance quality of the slide fastener 1 can be improved. Further, defects such as fray of the thread on the side surface part of the right and left tape members 20 facing to each other is less likely to occur. Therefore, quality and performance of the slider 14 such as slidability can be stably maintained for a long period of time even when the sliding operation of the slide fastener 14 is conducted repeatedly.

It should be noted that in Embodiment 1, the first and second core string portions 24*a*, 24*b* are formed by fixing the first and second string members 25*a*, 25*b* formed of twisted yarns at the tape side edge portion 22 of the tape body 23. However, in the present invention, it is also possible that, for the first and second string members 25*a*, 25*b* forming the first and second core string portions 24*a*, 24*b*, a monofilament or a knit cord obtained by banding a plurality of threads and knitting around the threads is used instead of the above-mentioned twisted yarn.

And in Embodiment 1, the fastener stringer 10 is manufactured by injection-molding a synthetic resin material to the tape side edge portion 22 of the tape member 20 on which the above-mentioned the first and second core string portions 24*a*, 24*b* are formed, and by forming a plurality of fastener elements 15 having a predetermined shape.

In this case, each fastener element 15 may be formed in a size to overlap the tape sewing line 29 (to be beyond the tape sewing line 29) at which the first tape fixing portion 22*a* and the second tape fixing portion 22*c* of the tape side edge portion 22 are sewn, or may be formed in a size not to overlap the tape sewing line 29 (a size formed within a region between the folded portion 22*b* and the tape sewing line 29).

Further, two fastener stringers 10 of Embodiment 1 as manufactured above are combined as a pair, and a slider 14 is attached to, and a first end stop 12 and a separable rear end stop 13 are formed on, element rows 11 of the pair of fastener stringers 10, thereby the slide fastener 1 as shown in FIG. 1 is manufactured.

In the slide fastener 1 of Embodiment 1 obtained as above, the tape member 20 having the first and second core string portions 24*a*, 24*b* bulging in the top and back direction is manufactured by preparing a tape body 23 having waterproof property and moisture permeability and fixing the first and second string members 25*a*, 25*b* to the tape side edge portion 22 of the tape body 23 afterwards. Therefore, the tape member 20 for a slide fastener having waterproof property and moisture permeability can be manufactured at a relatively low cost and easily.

Further, since the first and second string members 25*a*, 25*b* are firmly fixed by crossing (or interlooping) of the needle thread 26 to be formed, a position of the first and second string members 25*a*, 25*b* fixed to the tape side edge portion 22 is less likely to be misaligned in the tape width direction and the tape length direction.

Thereby, when the fastener elements 15 are formed by injection molding to the tape side edge portion 22 of the tape member 20, the fastener elements 15 can be stably attached to a predetermined position while preventing water leakage, and it can also be effectively prevented that a posture of the formed fastener element 15 is leaned, or a position of the fastener element 15 is misaligned in the tape length direction.

Therefore, added value that the tape member 20 has waterproof property and moisture permeability is added to the slide fastener 1 of Embodiment 1, in addition to having the primary properties of the slide fastener such as lateral pulling strength appropriately and stably. Further, since slide resistance of the slider 14 is reduced due to the thinness of the tape body 23, slidability of the slide fastener 14 is increased, and the slide fastener 1 becomes a high quality slide fastener. The slide fastener having such a feature are suitably used for outdoor products, for example.

It should be noted that in the above-mentioned Embodiment 1, the tape side edge portion 22 of the tape member 20 are formed to have the first tape fixing portion 22*a* on which the first core string portion 24*a* is formed, the folded portion 22*b* in a substantially U-shape and the second tape fixing portion 22*c* on which the second core string portion 24*b* is formed, as shown in FIG. 8. However, a shape of the tape side edge portion 22 in the present invention is not limited thereto, and the tape side edge portions 32, 42 may be formed in a shape as shown in FIGS. 14 and 15.

Figure 14:
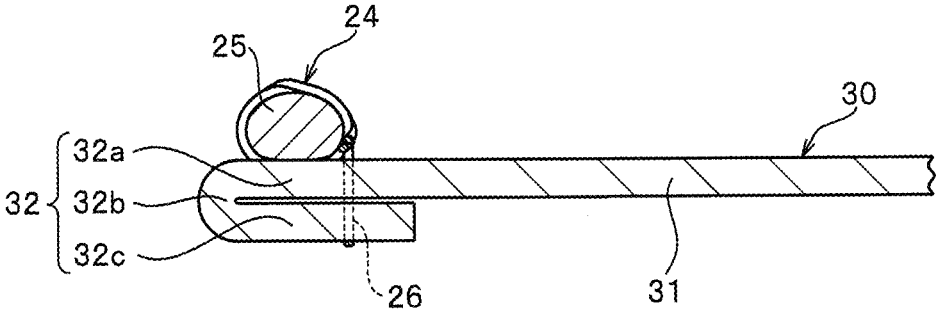
FIG. 14 is a cross-sectional view illustrating a cross section of the tape member according to a modification example of Embodiment 1.
Figure 15:
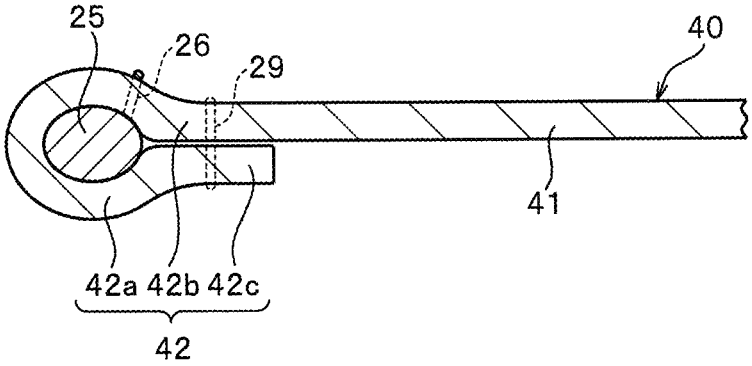
FIG. 15 is a cross-sectional view illustrating a cross section of the tape member according to another modification example of Embodiment 1.

As in FIG. 14 showing a cross-sectional view of the tape member 30 according to a first modification example of Embodiment 1, for example, the tape side edge portion 32 of the tape member 30 according to the first modification example has a tape fixing portion 32*a* disposed from the tape main body portion 31 continuously in the tape width direction and in which the core string portion 24 is formed on the member top surface, a folded portion 32*b* extending from the tape fixing portion 32*a* and folded on the member back surface side in a substantially U-shape and a tape turning back portion 32*c* extending from the folded portion 32*b* to the tape inside and overlapped with the tape fixing portion 32*a*.

In this case, a part of the tape fixing portion 32*a* close to the tape main body portion 31 and a tip end part of the tape turning back portion 32*c* are sewn to each other with the needle thread 26 which fixes the string member 25 to the tape fixing portion 32*a* in a state that the tape fixing portion 32*a* and the tape turning back portion 32*c* are overlapped.

The core string portion 24 in the first modification example is provided linearly at the tape fixing portion 32*a* of the tape side edge portion 32 along the tape length direction.

The core string portion 24 is formed such that one string member 25 composed of a twisted yarn is disposed linearly along the tape length direction, and the string member 25 is fixed with one needle thread 26 which is a fixing thread thinner than the string member 25.

Stitches of the needle thread 26 fixing the string member 25 of the first modification example are formed as same as the stitches of the needle thread 26 fixing the first and second string members 25*a*, 25*b* in the first and second core string portions 24*a*, 24*b* in the above-mentioned Embodiment 1.

It means that the core string portion 24 in the first modification example is formed such that the string member 25 is used as a looper thread, sewing processing is conducted as same as the case of the above-mentioned Embodiment 1 and the string member 25 is fixed to the tape fixing portion 32*a* with the needle thread 26. In this case, in the multi-thread chain stitch sewing machine, multi-thread chain stitching is conducted with the sewing machine needle 5 and the looper 6, and the string member 25 is drawn linearly by applying tension strongly and intermittently at a predetermined timing, similar to the case of Embodiment 1.

In the first modification example, the tape fixing portion 32*a* and the tape turning back portion 32*c* of the tape side edge portion 32 are sewn with the needle thread 26 as same as the needle thread 26 fixing the string member 25 to the tape fixing portion 32*a*, as mentioned above.

For example, the tape side edge portion 22 of the above-mentioned Embodiment 1 is, as shown in FIGS. 6 to 8, formed such that after the first and second string members 25*a*, 25*b* are fixed to the first and second tape fixing portions 22*a*, 22*c*, respectively, the second tape fixing portion 22*c* is folded back and sewn to the first fixing portion 22*a*.

On the other hand, in the first modification example shown in FIG. 14, the tape turning back portion 32*c* of the tape side edge portion 32 is folded back and overlapped on the tape fixing portion 32*a* before the string member 25 is fixed to the tape side edge portion 32. Then sewing processing is conducted for forming the core string portion 24 as mentioned above with the multi-thread chain stitch sewing machine in a state that the tape turning back portion 32*c* is overlapped on the tape fixing portion 32*a*, thereby the string member 25 is fixed on a top surface of the tape fixing portion 32*a* (a tape surface opposite to the tape surface on which the tape turning back portion 32*c* is overlapped), and at the same time, the overlapped tape fixing portion 32*a* and the tape turning back portion 32*c* are sewn.

In the tape side edge portion 32 of the first modification example thus formed, the string member 25 is firmly fixed to the member top surface of the tape fixing portion 32*a*, and the core string portion 24 is formed easily and stably on only the member top surface of the tape side edge portion 32.

In this case, even when the tape side edge end of the tape turning back portion 32*c* remains unprocessed after cut, the unprocessed side edge end is not exposed on the side surface part of the right and left tape members 30 facing to each other. Therefore, in the first modification example, an appearance quality of the slide fastener 1 can be improved as in the case of Embodiment 1 as above. Further, defects such as fray of the thread on the side surface parts of the right and left tape members 30 facing to each other are less likely to occur. Therefore, quality and performance of the slide fastener 1 can be stably maintained for a long period of time.

In the first modification example of Embodiment 1, the string member 25 is fixed to the tape fixing portion 32*a* and the tape turning back portion 32*c* is sewn to the tape fixing portion 32*a* simultaneously. However, it is also possible in the present invention that the string member 25 is fixed to the tape fixing portion 32*a* without sewing the tape turning back portion 32*c* to the tape fixing portion 32*a*, and thereafter, the tape turning back portion 32*c* is folded back to the tape fixing portion 32*a*, and the tape turning back portion 32*c* is fixed to the tape fixing portion 32*a* by bonding or by holding it with the fastener elements 15 which are injection-molded.

Meanwhile, the tape member 40 as shown in FIG. 15 according to the second modification example of Embodiment 1 has, when viewing a cross section perpendicular to the length direction of the tape member 40, a tape covering portion 42*a* which wraps and covers the fixed string member 25 inside, a first adjacent portion (tape inside adjacent portion) 42*b* extending from a first end edge on the tape main body portion side in the tape covering portion 42*a* and a second adjacent portion (tape outside adjacent portion) 42*c* extending from a second end edge in the tape covering portion 42*a* opposite to the first end edge.

In this case, the first adjacent portion 42*b* is disposed adjacent to the tape main body portion side of the tape covering portion 42*a*, and the second adjacent portion 42*c* is disposed adjacent to the opposite side of the tape covering portion 42*a*. The first adjacent portion 42*b* is continuously disposed from the tape main body portion 41 in the tape width direction, and the tape covering portion 42*a* and the second adjacent portion 42*c* are serially disposed from the first adjacent portion 42*b* in the tape width direction.

In this second modification example, the core string portion 24 is formed in the first place by fixing the string member 25 to the second tape surface of the tape covering portion 42*a*, subsequently, the string member 25 is wrapped with the tape covering portion 42*a* inside so that the tape covering portion 42*a* covers the peripheral surface of the fixed string member 25 to twist around it, and the second adjacent portion 42*c* is overlapped with the first adjacent portion 42*b*. Thereafter, the overlapped second adjacent portion 42*c* and the first adjacent portion 42*b* are sewn along the string member 25, thereby the tape side edge portion 42 is formed.

The core string portion 24 in the second modification example is formed such that one string member 25 composed of a twisted yarn is fixed to the tape covering portion 42*a* linearly along the tape length direction by conducting a sewing processing using the string member 25 as a looper thread and a multi-thread chain stitch sewing machine similar to the case of the above-mentioned Embodiment 1. In this second modification example, stitches of the needle thread 26 which fixes the string member 25 are formed similar to the case of the first and second core string portions 24*a*, 24*b* in the above-mentioned Embodiment 1.

In the tape side edge portion 42 of the second modification example thus formed, the string member 25 is firmly fixed to the inner peripheral surface (second tape surface) of the tape covering portion 42*a*, and the core string portion 24 is stably formed. As the fixed string member 25 is wrapped and protected with the tape covering portion 42, the core string portion 24 is less likely to be fluffed, and durability of the core string portion can be improved.

Further, also in this second modification example, the tape side edge end of the second adjacent portion (tape outside adjacent portion) 42*c* is not exposed on the side surface part of the right and left tape members 40 facing to each other. Therefore, even when the tape side edge end remains unprocessed after cut, an appearance quality of the slide fastener 1 can be improved, and quality and performance of the slide fastener 1 can be stably maintained for a long period of time, as same as in the above-mentioned Embodiment 1 and the first modification example.

Embodiment 2

Figure 16:
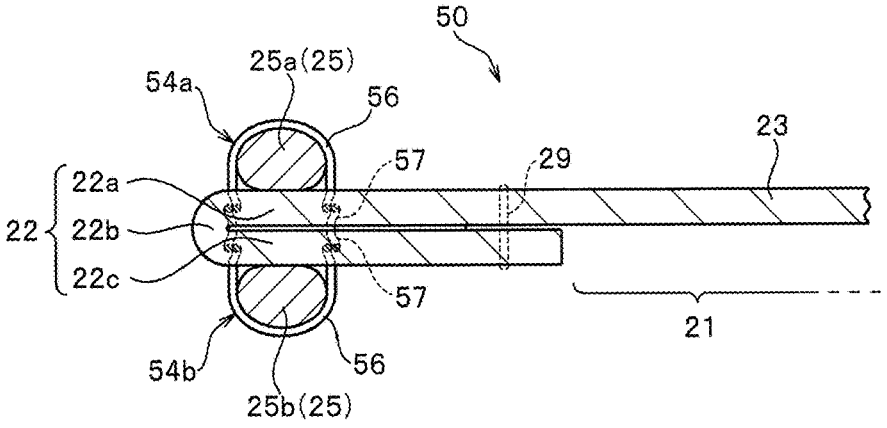
FIG. 16 is a cross-sectional view illustrating a tape side edge portion of a tape member according to Embodiment 2 of the present invention.
Figure 17:
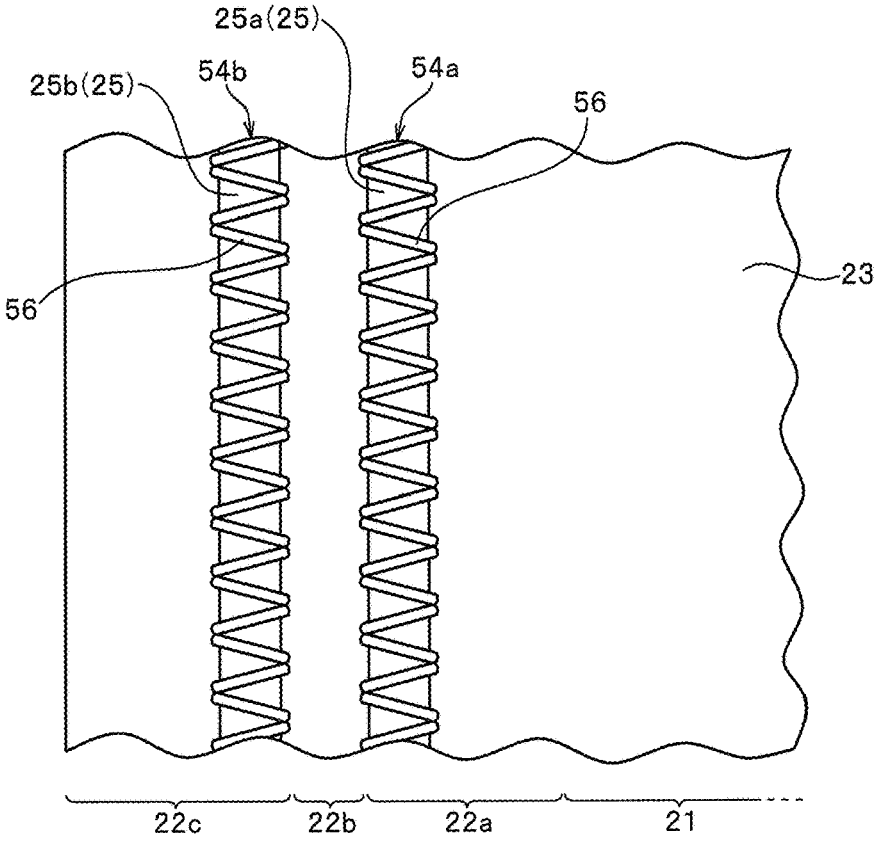
FIG. 17 is a plan view illustrating the tape side edge portion before a second tape fixing portion is folded back in the tape member.
Figure 18:
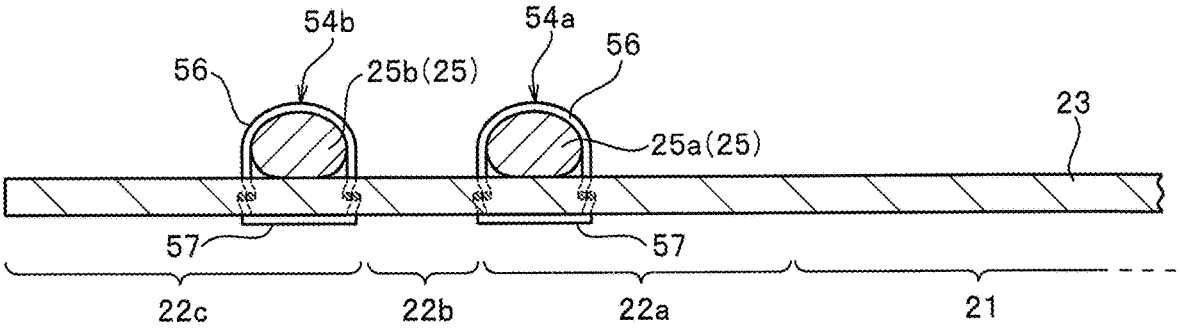
FIG. 18 is a cross-sectional plan view illustrating the tape side edge portion before the second tape fixing portion is folded back in the tape member.
Figure 19:
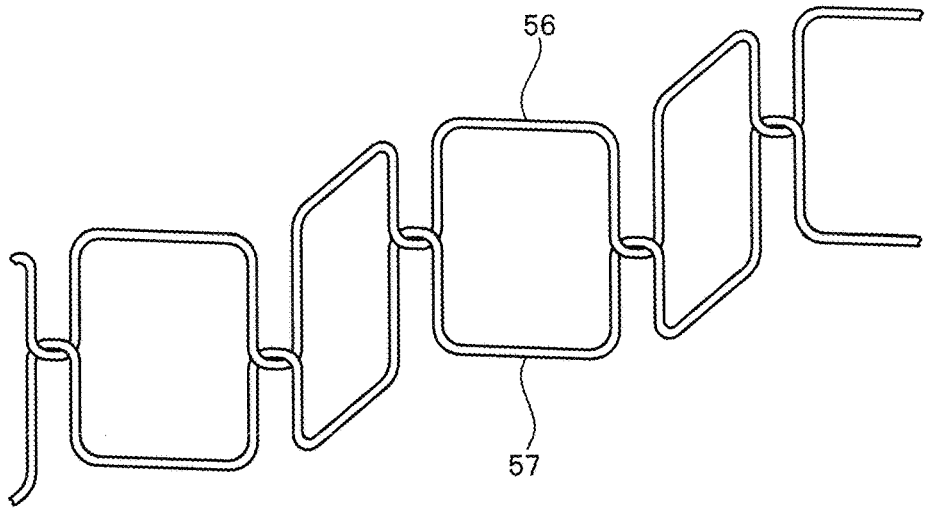
FIG. 19 is a schematic view illustrating schematically lock stitches fixing the string member to the tape side edge portion.

FIG. 16 is a cross-sectional view illustrating a tape side edge portion of the tape member according to Embodiment 2. FIGS. 17 and 18 are a plan view and a cross-sectional view illustrating the tape side edge portion in the tape member before the second tape fixing portion is folded back. FIG. 19 is a schematic view illustrating lock stitches fixing the string member to the tape side edge portion schematically.

In the tape member 50 of Embodiment 2, zigzag-shaped lockstitches with the needle thread 56 and the bobbin thread 57 are used instead of the stitches with the needle thread 26 in the above-mentioned Embodiment 1 as a means to fix the first and second string members 25*a*, 25*b* to the tape side edge portion 22 of the tape body 23.

The structure of the tape member 50 in Embodiment 2 is formed substantially as same as the one in Embodiment 1 except the stitches fixing the first and second string members 25*a*, 25*b*. Therefore, in Embodiment 2, structures which are different from the above-mentioned Embodiment 1 are mainly explained, and parts and members having substantially same structures as the above-mentioned Embodiment 1 are not explained but represented with the same reference signs.

The tape member 50 of Embodiment 2 has a tape body 23 formed by cutting a cloth having flexibility, waterproof property and moisture permeability in a narrow width shape and the first and second core string portions 54*a*, 54*b* provided at the tape side edge portion 22 of the tape body 23 along the tape length direction. The tape body 23 of Embodiment 2 is formed as same as the tape body 23 of the above-mentioned Embodiment 1.

The tape side edge portion 22 of the tape member 50 has a first tape fixing portion 22*a* extending from the tape main body portion 21 and on which a first core string portion 54*a* is formed, the folded portion 22*b* extending from the first tape fixing portion 22*a* and folded in a substantially U-shape and a second tape fixing portion 22*c* extending further from the folded portion 22*b* and on which a second core string portion 54*b* is formed. Further, the first tape fixing portion 22*a* and the second tape fixing portion 22*c* are sewn to each other in an overlapped state with a tape sewing line 29 formed on a part close to the tape main body portion 21.

In this case, the first core string portion 54*a* is provided linearly on the member top surface (in other words, a first tape surface of the first tape fixing portion 22*a*) of the tape side edge portion 22 along the tape length direction, and the second core string portion 54*b* is provided linearly on the member back surface (in other words, the first tape surface of the second tape fixing portion 22*c*) along the tape length direction.

Each first and second core string portions 54*a*, 54*b* is formed such that one string member 25 formed of a twisted yarn (i.e. the first string member 25*a* or the second string member 25*b*) is disposed linearly along the tape length direction, and the string member 25 is fixed by lock stitching in a zigzag shape formed with a needle thread 56 and a bobbin thread 57 which are thinner than the string member 25.

The lock stitches which fixes the first and second string members 25*a*, 25*b* to the tape side edge portion 22 in Embodiment 2 is formed to be bend in a zigzag shape with respect to the first or second string member 25*b* such that the stitch pattern of the needle thread 56 and the bobbin thread 57 as shown in FIG. 19 are continuously repeated in the tape length direction.

In this case, the first or second string member 25*a*, 25*b* is disposed to be inserted between the first tape surface of the tape side edge portion 22 and the needle thread 56, and the needle thread 56 forming the stitches extends across and in contact with the outer peripheral surface of the string member 25 in a zigzag shape, thereby the first or second string member 25*a*, 25*b* is fixed to the first tape surface of the tape side edge portion 22.

The stitch pattern shown in FIG. 19 is a stitch pattern designated as the symbol 304 in JIS L0120-1984. That is, in the stitch pattern used in Embodiment 2, the needle thread 56 runs on the first tape surface of the tape side edge portion 22, and the needle thread 56 passes through the tape side edge portion 22 from the first tape surface to the second tape surface, and crosses (interloops) with the bobbin thread 57 in the second tape surface.

When the needle thread 56 crosses the bobbin thread 57, the needle thread 56 is pulled back, thereby a crossed part of the needle thread 56 and the bobbin thread 57 is drawn into the tape side edge portion 22, and a stitch is formed. Further, each stitch (stitch part) formed per stitch of the sewing machine needle 5 is formed in a crossing direction with respect to the adjacent stitch, thereby the continuing plural stitches are disposed in a zigzag shape so as to run over the string member 25.

In a case of manufacturing the tape member 50 of Embodiment 2 as above, the first or second string member 25*a*, 25*b* is supplied to the tape side edge portion 22 of the tape body 23 in a flat state so as to be inserted between the first tape surface of the tape side edge portion 22 and the needle thread 56 as shown in FIGS. 17 and 18, and the first and second string member 25*a*, 25*b* is fixed by lock stitching in a zigzag shape which repeats the stitch pattern as shown in FIG. 19 using a sewing machine, thereby the first and second core string portions 54*a*, 54*b* are serially (or simultaneously) formed.

In this case, the first string member 25*a* is firmly fixed to the first tape fixing portion 22*a* of the flat tape side edge portion 22 without being pierced with the needle thread 56, and the second string member 25*b* is firmly fixed to the second tape fixing portion 22*c* without being pierced with the needle thread 56. Thereby, as shown in FIGS. 17 and 18, the first and second core string portions 54*a*, 54*b* disposed linearly and parallel to each other can be easily and efficiently formed at the tape side edge portion 22 of the tape body 23 having waterproof property and moisture permeability.

After the first and second core string portions 54*a*, 54*b* are formed as mentioned above, the second tape fixing portion 22*c* of the tape side edge portion 22 is folded back in the tape width direction with respect to the first tape fixing portion 22*a* and overlapped based on an intermediate position of the first core string portion 54*a* and the second core string portion 54*b* so that the second tape surface on which the bobbin thread 57 of the tape side edge portion 22 runs faces inward. Thereby, the folded portion 22*b* between the first tape fixing portion 22*a* and the second tape fixing portion 22*c* is folded in a substantially U-shape.

Further, the overlapped first tape fixing portion 22*a* and the second tape fixing portion 22*c* are sewn by sewing with a multi-thread chain stitch sewing machine, for example, at a position between the first and second string members 25*a*, 25*b* and the tape main body portion 21. Thereby, the tape sewing line 29 is formed by multi-thread chain stitching along the first and second string members 25*a*, 25*b*.

As the first tape fixing portion 22*a* and the second tape fixing portion 22*c* are sewn with the tape sewing line 29 as above, the tape member 50 of Embodiment 2 having the tape side edge portion 22 as shown in FIG. 16 is manufactured. Further, a synthetic resin material is injection-molded to the tape member 50 of Embodiment 2 to form a plurality of fastener elements 15 having the same shape as the case of Embodiment 1 as above at predetermined attaching pitches, thereby a fastener stringer is manufactured.

As mentioned above, in Embodiment 2, the first and second string members 25*a*, 25*b* are fixed to the tape side edge portion 22 of the tape body 23 having waterproof property and moisture permeability by zigzag-shaped lock stitching.

Therefore, the stitches of lock stitching are firmly and strongly formed, and the tape member 50 having waterproof property and moisture permeability in which the first and second core string portions 54*a*, 54*b* bulging in the top and back direction are firmly formed at the tape side edge portion 22 can be manufactured at relatively low cost and easily.

And by manufacturing a slide fastener using the fastener stringer 10 of Embodiment 2, a high quality slide fastener having its primary properties appropriately and stably, and in which the tape member 50 has waterproof property and moisture permeability, and slidability of the slider 14 is improved can be easily obtained.

It should be noted that in the above-mentioned Embodiment 2, the first and second string members 25*a*, 25*b* are fixed to be inserted between the first tape surface of the tape side edge portion 22 and the needle thread 56. However, it is also possible that when the tape member 50 is manufactured, the first or second string member 25*a*, 25*b* is supplied to be inserted between the second tape surface of the tape side edge portion 22 and the bobbin thread 57, and zigzag-shaped lock stitching is conducted, thereby the first and second core string portions 54*a*, 54*b* are formed on the second tape surface of the tape side edge portion 22.

Further, in the above-mentioned Embodiment 2, the tape side edge portion 22 of the tape member 50 is formed to have the first tape fixing portion 22*a* on which the first core string portion 54*a* is formed, the folded portion 22*b* having a substantially U-shape and the second tape fixing portion 22*c* on which the second core string portion 54*b* is formed as shown in FIG. 16. However, in the present invention, it is also possible that the tape side edge portion of the tape member 50 is formed in a shape of the tape side edge portion 32 (see FIG. 14) having the tape fixing portion 32*a*, folded portion 32*b* and the tape turning back portion 32*c* as explained in the first modification example of Embodiment 1 using the zigzag-shaped lock stitching explained in Embodiment 2, or it is formed in a shape of the tape side edge portion 42 (see FIG. 15) having the tape covering portion 42*a*, the first adjacent portion 42*b* and the second adjacent portion 42*c*, as explained in the second modification example of Embodiment 1 using the zigzag-shaped lock stitching explained in Embodiment 2.

Further, in the above-mentioned Embodiment 2, the stitch pattern designated as the symbol 304 in JIS L0120-1984 (FIG. 19) is adopted as the stitch pattern of lock stitching for fixing the first and second string members 25*a*, 25*b* to the tape side edge portion 22. However, in the present invention, instead of this stitch pattern, the stitch pattern designated as the symbol 404 in JIS L0120-1984, for example, may be adopted to fix the first and second string members 25*a*, 25*b* to the tape side edge portion 22. The stitch pattern designated as the symbol 404 in JIS L0120-1984 is a stitch pattern in which stitches formed by multi-thread chain stitching with a needle thread and a looper thread are disposed in a zigzag shape.

Embodiment 3

Figure 20:
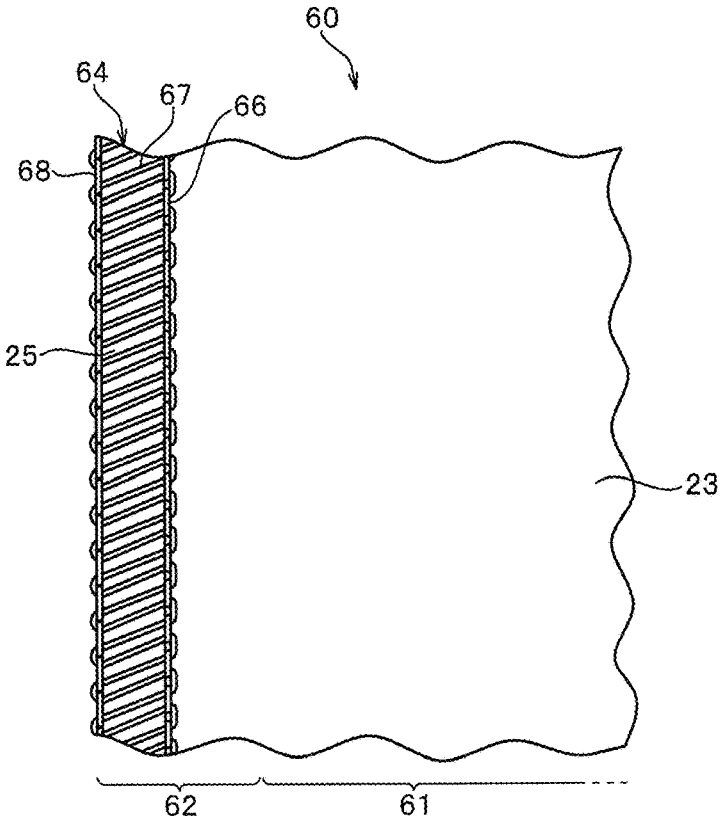
FIG. 20 is a plan view illustrating a tape side edge portion of a tape member according to Embodiment 3 of the present invention.
Figure 21:
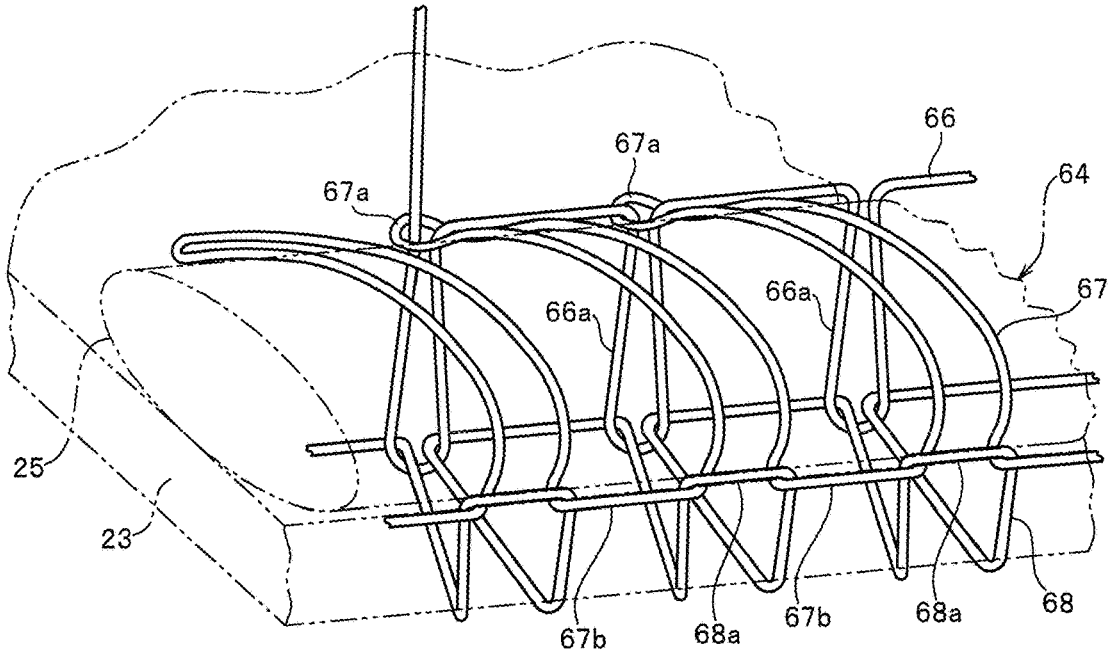
FIG. 21 is a schematic view illustrating schematically overedge chain stitches fixing the string member to the tape side edge portion.

FIG. 20 is a plan view illustrating the tape side edge portion of the tape member according to Embodiment 3. FIG. 21 is a schematic view illustrating schematically overedge chain stitches for fixing the string member to the tape side edge portion.

In a tape member 60 of Embodiment 3, as a means of fixing the string member 25 to a tape side edge portion 62 of the tape body 23, overedge chain stitching (also referred to as overlock stitching) formed using a needle thread 66 and two looper threads 67, 68 is adopted.

The structure of the tape member 60 of Embodiment 3 is formed substantially as same as the one in Embodiment 1 except the stitches fixing the string member 25. Therefore, in Embodiment 3, parts and members having substantially same structures as the above-mentioned Embodiment 1 are not explained in detail but are represented with the same reference signs.

The tape member 60 of Embodiment 3 has the tape body 23 formed by cutting a cloth having flexibility, waterproof property and moisture permeability in a narrow width shape and a core string portion 64 provided linearly on the member top surface of the tape side edge portion 62 of the tape body 23 along the tape length direction.

The tape side edge portion 62 of the tape member 60 (not shown in Figures) has a tape fixing portion continuously disposed from the tape main body portion 61 in the tape width direction and on which the core string portion 64 is formed on the member top surface, a folded portion extending from the tape fixing portion and folded on the tape back surface side in a substantially U-shape, and a tape turning back portion extending from the folded portion to tape inward and overlapped and sewn to the tape fixing portion, as in the case of the first modification example of Embodiment 1. In this case, at the same time the string member 25 is fixed to the tape fixing portion with overedge chain stitches, the tape turning back portion of Embodiment 3 is sewn to the tape fixing portion with the same overedge stitches.

The core string portion 64 of Embodiment 3 is formed such that one string member 25 formed of a twisted yarn is disposed linearly along the tape length direction, and the string member 25 is fixed with the overedge chain stitches formed with the needle thread 66 which is thinner than the string member 25 and the first and second looper threads 67, 68 which are thinner than the string member 25.

The overedge chain stitches of Embodiment 3 are formed by repeating the stitch pattern as shown in FIG. 21 continuously in the tape length direction. The first looper thread 67 forming the stitches extends across and in contact with the outer peripheral surface of the string member 25 so as to be leaned obliquely in the tape width direction at regular intervals in the tape length direction, thereby the string member 25 is fixed to the member top surface of the tape side edge portion 62.

The stitch pattern shown in FIG. 21 is the stitch pattern of the overedge chain stitch designated as the symbol 504 of JIS L0120-1984. That means, in the stitch pattern used in Embodiment 3, the needle thread 66 runs on the first tape surface (first tape surface of the tape fixing portion) of the tape side edge portion 62, and the loop 66*a* of the needle thread 66 passes through the first loop 67*a* of the first looper thread 67 and the tape side edge portion 62, and crosses (interloops) with the second looper thread 68 on the second tape surface of the tape side edge portion 62. The loop 68*a* of the second looper thread 68 crosses (interloops) with the second loop 67*b* of the first looper thread 67 on the side surface part of the facing side edges in the tape side edge portion 62.

In this case, the first loop 67*a* of the first looper thread 67 is drawn from a position at which the second loop 67*b* of the first looper thread 67 crosses with the loop 68*a* of the second looper thread 68 to a needle piercing point in the next stitch while contacting with the outer peripheral surface of the string member 25, thereby the first loop 67*a* of the first looper thread 67 obliquely crosses the string member 25. Thus, the string member 25 is stably fixed to the tape side edge portion 62 with the stitches shown in FIG. 21.

When the tape member 60 of Embodiment 3 having the above-mentioned shape is manufactured, first, the tape turning back portion of the tape side edge portion 62 is folded back and overlapped on the tape fixing portion, and further, sewing processing is conducted to form overedge chain stitches as mentioned above using a sewing machine in a state that the tape turning back portion is overlapped on the tape fixing portion.

As the sewing processing is thus conducted, it is possible that the string member 25 is fixed to the member top surface (tape surface opposite to the tape surface on which the tape turning back portion of the tape fixing portion is overlapped) of the tape fixing portion with the first looper thread 67, and the tape fixing portion and the tape turning back portion which are overlapped are sewn with overedge chain stitches. Thereby, the tape member 60 of Embodiment 3 in which the tape side edge portion 62 has a tape fixing portion, a folded portion in a substantially U-shape and a tape turning back portion to be sewn to the tape fixing portion, and the core string portion 64 is formed on the member top surface of the tape fixing portion.

Further, a fastener stringer is manufactured by injection-molding a synthetic resin material to the manufactured tape member 60 of Embodiment 3, and forming a plurality of fastener elements 15 having the same shape as the ones of Embodiment 1 as above at predetermined attaching pitches.

As mentioned above, in Embodiment 3, the tape member 60 having the core string portion 64 at the tape side edge portion 62 and having waterproof property and moisture permeability can be easily manufactured at relatively low cost. Further, by manufacturing the slide fastener using the fastener stringer of Embodiment 3, a high-quality slide fastener having primary properties of the slide fastener appropriately and stably, in which the tape member 60 has waterproof property and moisture permeability, and slidability of the slider 14 is improved can be obtained easily.

It should be noted that in the above-mentioned Embodiment 3, the core string portion 64 is formed such that the string member 25 is fixed to the member top surface (first tape surface) of the tape fixing portion in the tape side edge portion 62 using the stitch pattern of overedge chain stitches as shown in FIG. 21. In the present invention, however, the core string portion can be formed by inserting the string member 25 between the member back surface of the tape side edge portion 62 and the second looper thread 68 in the stitch pattern of the overedge chain stitches as shown in FIG. 21, and crossing the loop of the second looper thread 68 with the outer peripheral surface of the string member 25 while contacting it to fix the string member 25 to the member back surface of the tape side edge portion 62.

Further, in Embodiment 3 as above, the stitch pattern of FIG. 21 designated as the symbol 504 in JIS L0120-1984 is adopted as the stitch pattern of overedge chain stitches for fixing the string member 25 to the tape side edge portion 62. In the present invention, however, it is also possible that the string member 25 is fixed to the tape side edge portion 62 by adopting the stitch pattern designated as the symbol 502 of JIS L0120-1984 and the stitch pattern as shown in FIG. 22 instead of this stitch pattern.

The stitch pattern designated as the symbol 502 in JIS L0120-1984 is a stitch pattern of overedge chain stitches formed using one needle thread and one looper thread. In this stitch pattern of the symbol 502, the needle thread runs on the first tape surface (member top surface) of the tape side edge portion 62, and the loop of the needle thread passes through the first loop of the looper thread and the tape side edge portion 62 and crosses (interloops) with the second loop of the looper thread on the second tape surface (member back surface) side of the tape side edge portion 62.

In this case, the first loop of the looper thread is drawn from a position of the second loop of the first looper thread disposed on the member back surface of the tape side edge portion 62 while contacting the side surface part of the facing side edges of the tape side edge portion 62 and moving from the second tape surface to the first tape surface to cross over the side surface part, and further is drawn to the needle piercing point in the next stitch while contacting the outer peripheral surface of the string member 25, thereby obliquely extends across the string member 25. Thus, the string member 25 is stably fixed to the tape side edge portion 62 with the stitches.

Figure 22:
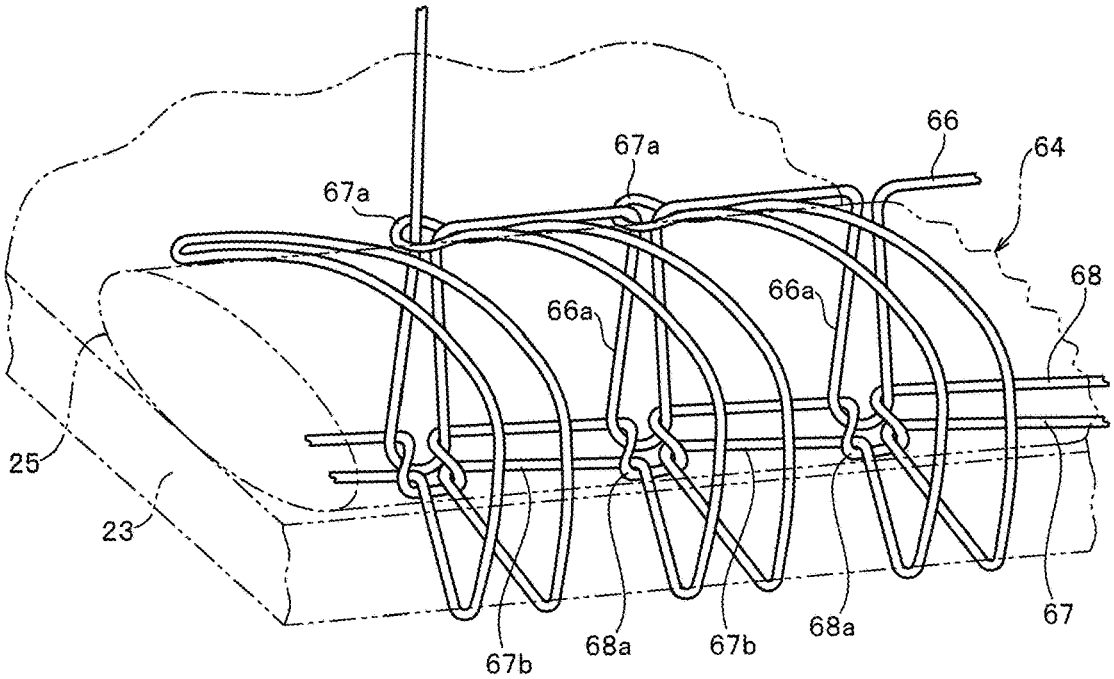
FIG. 22 is a schematic view illustrating schematically overedge chain stitches used in a modification example of Embodiment 3.

The stitch pattern shown in FIG. 22 is a stitch pattern shown in FIG. 21 (stitch pattern designated as the symbol 504 in JIS L0120-1984) formed by shortening the loop 68*a* of the second looper thread 68 and lengthening the first loop 67*a* of the first looper thread 67.

In the case of the stitch pattern as shown in FIG. 22, the first loop 67*a* of the first looper thread 67 is drawn from a position that the second loop 67*b* of the first looper thread 67 crosses with the loop 68*a* of the second looper thread 68, moves from the second tape surface to the first tape surface so as to cross over the side surface part of facing side edges of the tape side edge portion 62 while contacting the side surface part and drawn to the needle piercing point in the next stitch while contacting the outer peripheral surface of the string member 25. thereby obliquely crosses the string member 25. Thus, the string member 25 is stablyfixed to the tape side edge portion 62 with the stitches as shown in FIG. 22.

The same effect of the tape member 60 of Embodiment 3 as above can be obtained from the tape member in which the string member 25 is fixed to the tape side edge portion 62 using the stitch pattern designated as the symbol 502 in JIS L0120-1984 or the stitch pattern as shown in FIG. 22.

REFERENCE SIGNS

1: slide fastener
5: sewing machine needle
6: looper
10: fastener stringer
11: element row
12: first end stop
13: separable rear end stop
14: slider
15: fastener element
15*a*: first element portion
15*b*: second element portion
20: tape member
21: tape main body portion
22: tape side edge portion
22*a*: first tape fixing portion
22*b*: folded portion
22*c*: second tape fixing portion
23: tape body
24: core string portion
24*a*: first core string portion
24*b*: second core string portion
25: string member
25*a*: first string member
25*b*: second string member
26: needle thread
26*a*, 26*b*: loop of needle thread
26*z*: loop of needle thread
27*a*, 27*b*: loop of first string member
29: tape sewing line
30: tape member
31: tape main body portion
32: tape side edge portion
32*a*: tape fixing portion
32*b*: folded portion
32*c*: tape turning back portion
40: tape member
41: tape main body portion
42: tape side edge portion
42*a*: tape covering portion
42*b*: first adjacent portion
42*c*: second adjacent portion
50: tape member
54*a*: first core string portion
54*b*: second core string portion
56: needle thread
57: bobbin thread
60: tape member
61: tape main body portion
62: tape side edge portion
64: core string portion
66: needle thread
66*a*: loop of needle thread
67: first looper thread
67*a*: first loop of first looper thread
67*b*: second loop of first looper thread
68: second looper thread
68*a*: loop of second looper thread

The invention claimed is:

1. A slide fastener comprising a pair of fastener stringers in which each fastener stringer includes a plurality of fastener elements attached to a tape member, wherein:

each tape member comprises a flexible tape body and a core string portion disposed at a tape side edge portion of the tape body along a length direction and bulging in a top and back direction from the tape body, the core string portion is formed by fixing a string member to the tape side edge portion along a tape length direction by machine sewing, and the string member is fixed to the tape side edge portion linearly without being pierced by a needle thread of machine sewing and with at least one thread used for machine sewing crossing while contacting and surrounding an outer peripheral surface of the string member not in contact with the tape body, and each of the plurality of fastener elements is attached to the tape member and covers a part of the core string portion and a part of the at least one thread used for the machine sewing.

2. The slide fastener according to claim 1, wherein:

the string member is fixed only with the needle thread and is formed thicker than the needle thread.

3. The slide fastener according to claim 2, wherein:

the tape side edge portion comprises a first tape surface on which the needle thread runs and a second tape surface disposed opposite to the first tape surface and in which the needle thread pierces the tape side edge portion and forms loops, and the string member is fixed to the second tape surface of the tape side edge portion with the needle thread crossing the outer peripheral surface of the string member twice per stitch.

4. The slide fastener according to claim 1, wherein:

the string member is fixed with lock stitches formed to be bent in a zigzag shape with respect to the tape length direction using the needle thread and a bobbin thread, the tape side edge portion has a first tape surface on which the needle thread runs and a second tape surface disposed opposite to the first tape surface and on which the bobbin thread runs, and the string member is inserted between the needle thread and the first tape surface or between the bobbin thread and the second tape surface, and is fixed to the tape side edge portion with the needle thread or the bobbin thread crossing the outer peripheral surface of the string member in a zigzag shape.

5. The slide fastener according to claim 1, wherein:

the string member is fixed with overedge chain stitches formed using the needle thread and one or two looper threads, the tape side edge portion comprises a first tape surface on which the needle thread runs and a second tape surface disposed opposite to the first tape surface and on which the needle thread pierces the tape side edge portion and forms loops, and the string member is inserted between the looper thread and the first or the second tape surface, and is fixed to the tape side edge portion with the looper thread crossing the outer peripheral surface of the string member per stitch.

6. The slide fastener according to claim 1, wherein:

the string member comprises a first string member and a second string member disposed parallel to each other on one tape surface in the tape side edge portion, the tape side edge portion comprises a first tape fixing portion to which the first string member is fixed and a second tape fixing portion to which the second string member is fixed, and the second tape fixing portion is folded back with respect to the first tape fixing portion to the other tape surface of the first tape fixing portion.

7. The slide fastener according to claim 6, wherein:

the first tape fixing portion and the folded second tape fixing portion are sewn to each other with a tape sewing line formed at a position on a tape inside of the first and second string members along the first and second string members.

8. The slide fastener according to claim 1, wherein:

the tape side edge portion comprises a tape fixing portion fixing the string member to one tape surface and a tape turning back portion to be folded back to the other tape surface of the tape fixing portion with respect to the tape fixing portion, the tape turning back portion is sewn to the tape fixing portion together with the string member by machine sewing to fix the string member in a state that the tape turning back portion is folded back and overlapped on the tape fixing portion.

9. The slide fastener according to claim 1, wherein:

the tape side edge portion comprises, when viewing a cross section perpendicular to a length direction of the tape member, a tape covering portion wrapping and covering the string member inside, a first adjacent portion disposed adjacent to one side of the tape covering portion and a second adjacent portion disposed adjacent to the other side of the tape covering portion, and the first adjacent portion and the second adjacent portion are sewn to each other with a tape sewing line formed along the string member in a state that the string member is wrapped with the tape covering portion.

* * * * *